US012140133B2

(12) United States Patent
Yamada

(10) Patent No.: US 12,140,133 B2
(45) Date of Patent: Nov. 12, 2024

(54) DISPENSER

(71) Applicant: Kao Corporation, Tokyo (JP)

(72) Inventor: Takashi Yamada, Machida (JP)

(73) Assignee: Kao Corporation, Tokyo (JP)

( * ) Notice: Subject to any disclaimer, the term of this patent is extended or adjusted under 35 U.S.C. 154(b) by 154 days.

(21) Appl. No.: 17/762,672

(22) PCT Filed: Jul. 17, 2020

(86) PCT No.: PCT/JP2020/027975

§ 371 (c)(1),
(2) Date: Mar. 22, 2022

(87) PCT Pub. No.: WO2021/059696

PCT Pub. Date: Apr. 1, 2021

(65) Prior Publication Data

US 2022/0412335 A1 Dec. 29, 2022

(30) Foreign Application Priority Data

Sep. 25, 2019 (JP) ..... 2019-174809

(51) Int. Cl.
*F04B 43/02* (2006.01)

(52) U.S. Cl.
CPC ..... *F04B 43/02* (2013.01)

(58) Field of Classification Search
CPC ..... F04B 43/02
See application file for complete search history.

(56) References Cited

U.S. PATENT DOCUMENTS 7,806,301 B1 * 10/2010 Ciavarella ..... A47K 5/1208 222/207
11,633,526 B2 * 4/2023 Wilt ..... A61M 1/155 417/413.1
2005/0087555 A1 4/2005 Hatton et al.
(Continued)

FOREIGN PATENT DOCUMENTS

CN 1172214 A 2/1998
CN 101543807 A 9/2009
(Continued)

OTHER PUBLICATIONS

Machine Translation of JP-2001180728-A.*
(Continued)

*Primary Examiner* — Jeremy Carroll
(74) *Attorney, Agent, or Firm* — Oblon, McClelland, Maier & Neustadt, L.L.P.

(57) ABSTRACT

A dispenser, which has a pump chamber formed by a body including a depression, and a lid body covering an opening of the body, where a liquid in the pump chamber is discharged front a nozzle portion by performing a discharge operation that presses the lid body toward an inside of the pump chamber to deform the lid body, and a liquid is caused to flow into the pump chamber when the discharge operation is released. A coil spring that urges the lid body to an outside of the pump chamber is included in the pump chamber, a diameter of the coil spring is larger than a radius of the lid body, and a deformation amount of the lid body is equal to or more than ⅓ of a diameter of the lid body.

20 Claims, 19 Drawing Sheets

(56) References Cited

U.S. PATENT DOCUMENTS

| | | | | |
|---|---|---|---|---|
| 2006/0049208 | A1* | 3/2006 | Daansen | B65D 47/2031 222/212 |
| 2006/0186139 | A1* | 8/2006 | Laidler | B05B 11/1032 222/207 |
| 2008/0035677 | A1 | 2/2008 | Daansen | |
| 2008/0078781 | A1* | 4/2008 | Py | B65D 75/5883 222/401 |
| 2009/0294477 | A1 | 12/2009 | Ciavarella et al. | |
| 2010/0108718 | A1* | 5/2010 | Sayers | B05B 1/3436 222/207 |
| 2011/0031278 | A1 | 2/2011 | Han de Man | |
| 2013/0284763 | A1 | 10/2013 | Banks et al. | |
| 2014/0103071 | A1 | 4/2014 | Park et al. | |
| 2015/0048121 | A1 | 2/2015 | Daansen | |
| 2022/0235757 | A1* | 7/2022 | Brocker | F04B 43/02 |

FOREIGN PATENT DOCUMENTS

| | | | |
|---|---|---|---|
| CN | 103010569 | A | 4/2013 |
| CN | 103533861 | A | 1/2014 |
| CN | 206487 611 | U | 9/2017 |
| JP | 6-85253 | U | 12/1994 |
| JP | H0685253 | U * | 12/1994 |
| JP | 2000-117162 | A | 4/2000 |
| JP | 2001-63781 | A | 3/2001 |
| JP | 2001180728 | A * | 7/2001 |
| JP | 2006-520440 | A | 9/2006 |
| JP | 2007-509827 | A | 4/2007 |
| JP | 2013-543819 | A | 12/2013 |
| JP | 2015-520081 | A | 7/2015 |
| TW | 201900281 | A | 1/2019 |
| WO | WO 2012/081060 | A1 | 6/2012 |

OTHER PUBLICATIONS

Machine Translation of JP-H0685253-U.*

Extended European Search Report issued on Sep. 12, 2023 in European Patent Application No. 20868038.9, 4, pages.

International Search Report mailed on Aug. 25, 2020 in PCT/JP2020/027975 filed on Jul. 17, 2020, 3 pages.

* cited by examiner

DISPENSER

TECHNICAL FIELD

The present invention relates to a dispenser.

BACKGROUND ART

Patent Literature 1 describes a liquid ejector in which a pump chamber is formed by a dome that is formed into a semispherical shape and a depression to which the dome is fitted, and a liquid in the pump chamber is ejected from a nozzle by performing a discharge operation that presses the dome toward the depression to deform the dome. When the pump internal pressure is increased by the discharge operation, in this liquid ejector, a suction port is closed with a suction valve, the discharge valve is opened to open the nozzle, and thereby liquid is ejected from the nozzle. When the pressing force to the dome disappears in this liquid ejector, a deformed part that is deformed in the pump chamber is restored by a restoring force of the dome, the nozzle is closed with the discharge valve as a result that the pump chamber internal pressure becomes a negative pressure, and a liquid is sucked into the pump chamber by opening the suction port by opening the suction valve.

CITATION LIST

Patent Literature

Patent Literature 1: JP2001-63781A

SUMMARY OF INVENTION

The present invention relates to a dispenser in which a pump chamber is formed by a body including a depression, and a lid body covering an opening of the depression, a liquid in the pump chamber is discharged from a nozzle portion by performing a discharge operation that presses the lid body to an inside of the pump chamber to deform the lid body, and a liquid is caused to flow into the pump chamber by releasing the discharge operation. The dispenser of the present invention includes a coil spring that is arranged in the pump chamber, and urges the lid body to an outside of the pump chamber. A diameter of the coil spring is larger than a radius of the lid body. A deformation amount of the lid body is equal to or more than ⅓ of a diameter of the lid body.

DESCRIPTION OF EMBODIMENTS

In Patent Literature 1, the dome which is deformed by the discharge operation is urged in the restoration direction by using a repulsive force of the coil spring to restore the dome shape to the shape before deformation, but depending on the size relationship between the diameter of the dome and the diameter of the coil spring, only the part in contact with the coil spring may be restored, resulting in poor restoration of the dome. Poor restoration of the dome leads to fluctuations in operability and the amount of deformation of the dome, and also causes variations in the discharge amount and the suction amount of the liquid.

The present invention relates to a dispenser that can eliminate the disadvantages of the aforementioned conventional art.

Hereinafter, the present invention will be described based on preferable embodiments with reference to the drawings.

First Embodiment

Figure 1:
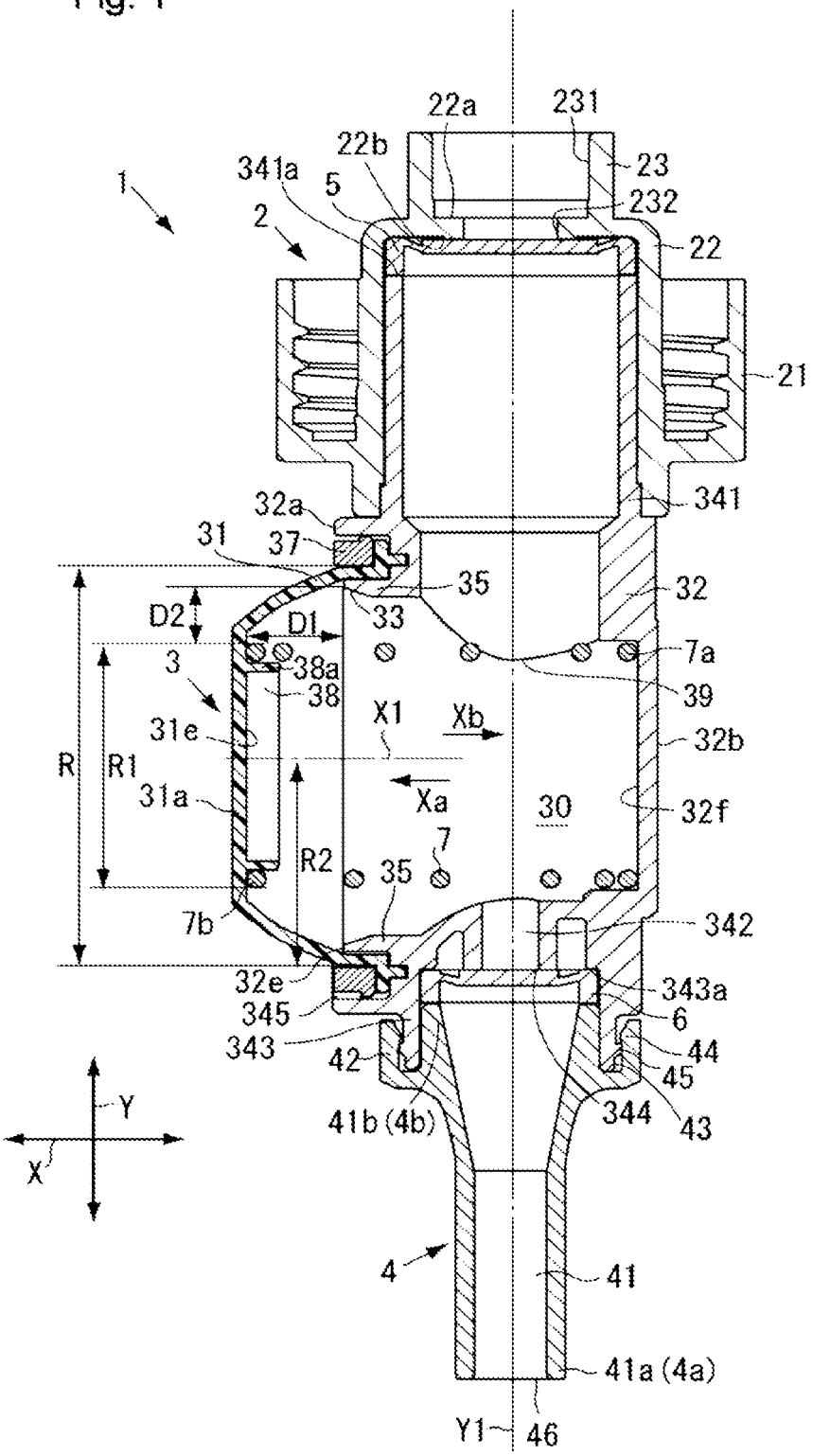
FIG. 1 is a sectional view explaining a configuration and a state before a discharge operation of a dispenser according to a first embodiment of the present invention.
Figure 2:
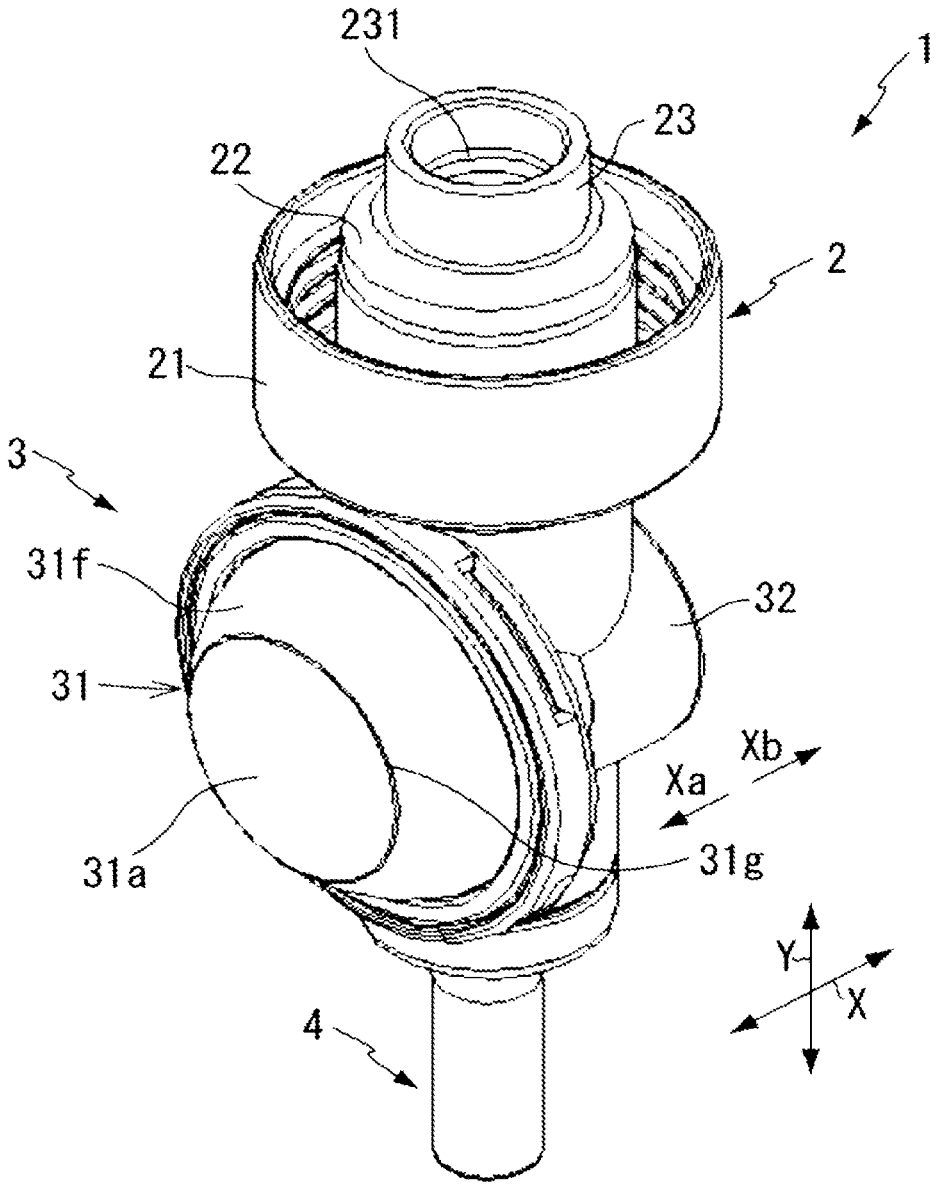
FIG. 2 is a perspective view explaining the configuration of the dispenser according to the first embodiment.
Figure 3:
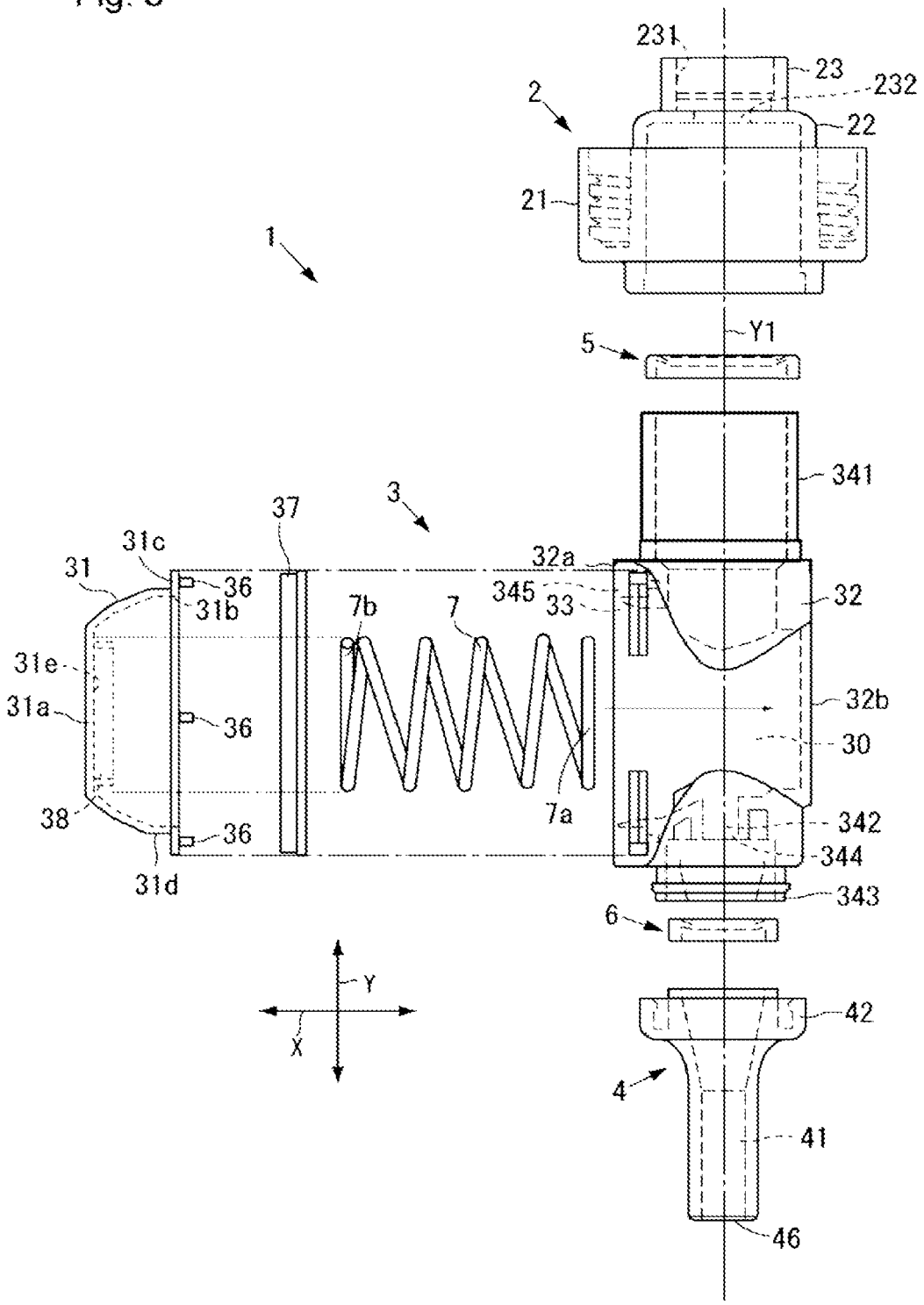
FIG. 3 is an exploded view explaining the configuration of the dispenser according to the first embodiment.
Figure 6:
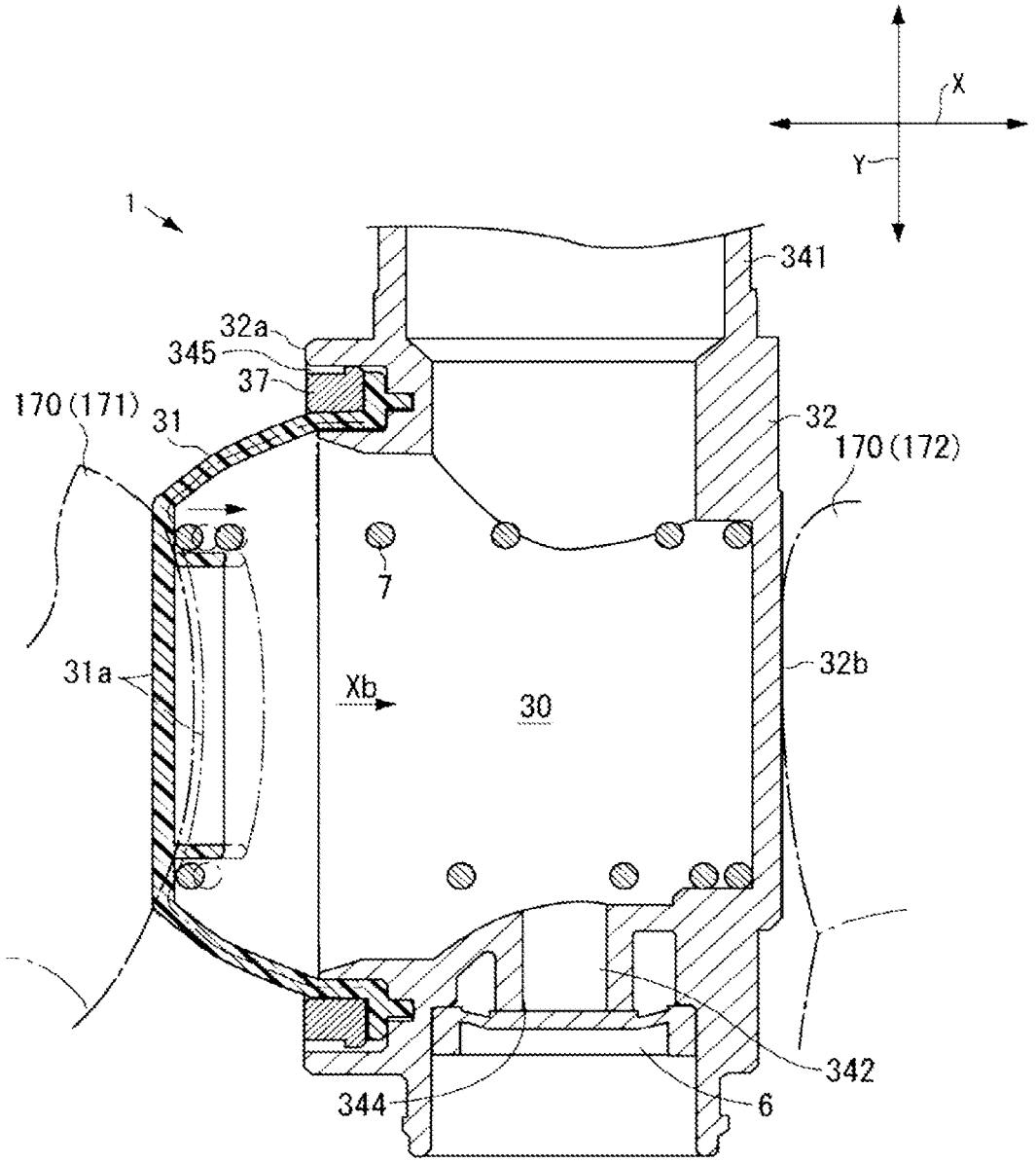
FIG. 6 is a sectional view showing an initial state of the discharge operation of the dispenser according to the first embodiment.
Figure 7:
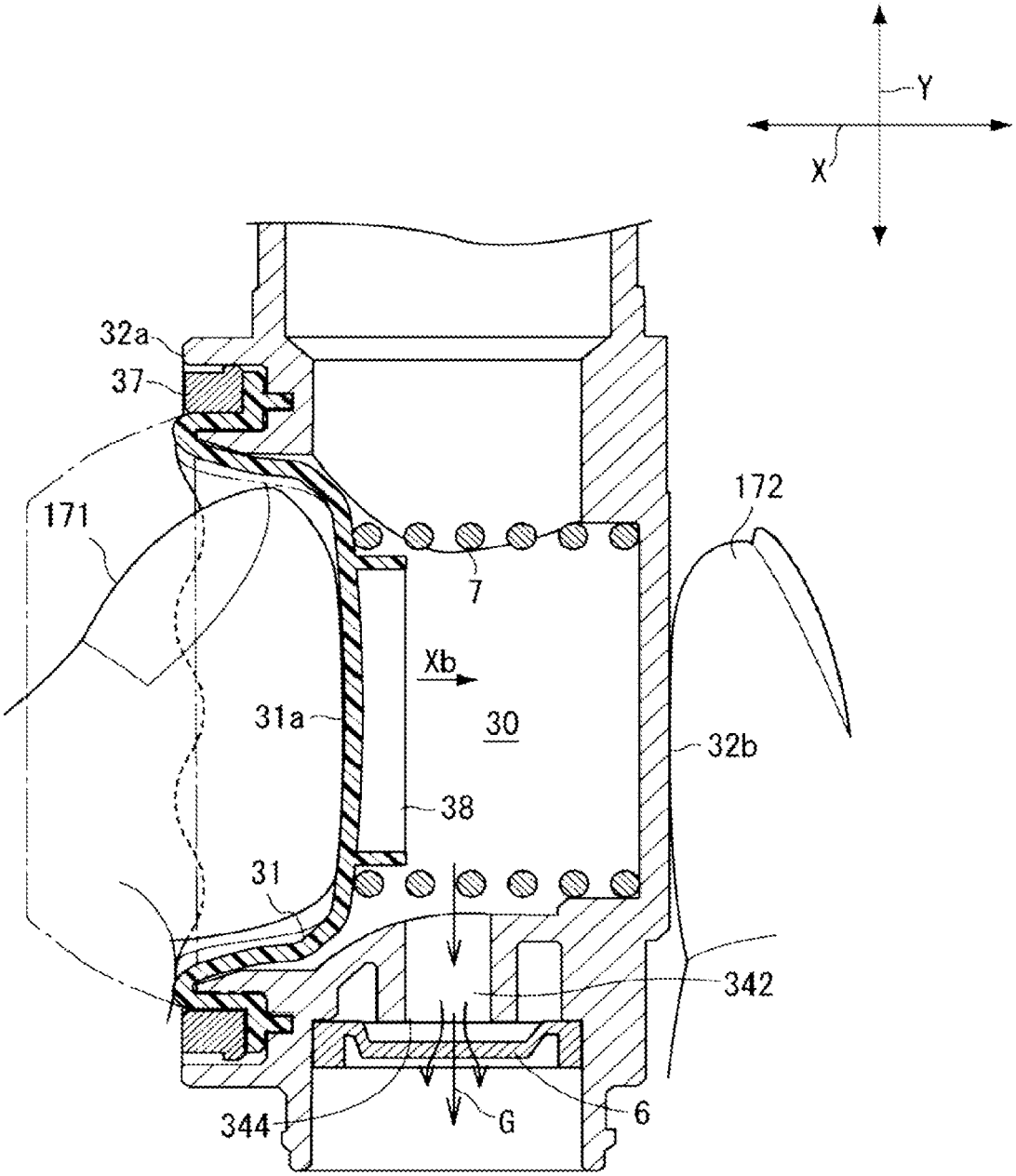
FIG. 7 is a sectional view showing a state after the discharge operation of the dispenser according to the first embodiment.

A dispenser 1 according to a first embodiment of the present invention includes a cap portion 2, a pump portion 3, and a nozzle portion 4 as shown in FIG. 1 to FIG. 3. FIG. 1 and FIG. 2 show states before a discharge operation of the dispenser 1. FIG. 6 and FIG. 7 show states after starting the discharge operation of the dispenser 1, FIG. 6 shows a state directly after start of the operation, and FIG. 7 shows a state after the discharge operation. "Before the discharge operation" refers to a state before performing a discharge operation to the dispenser 1, and "after the discharge operation"

refers to a state after the discharge operation is performed to the dispenser 1. FIG. 3 is an exploded view explaining a configuration of the dispenser 1.

The pump portion 3 includes a casing 32 as a body that has a depression 39 inside, and a lid body 31 that is fitted to the casing 32. A pump chamber 30 is formed by the lid body 31 and the casing 32. The casing 32 forms a substantially bottomed cylindrical shape. In the casing 32, an opening 33 is formed in one end surface 32*a* in an axial direction X thereof, and an end surface 32*b* on an opposite side that faces the end surface 32*a* is formed into a flat surface.

Figure 4:
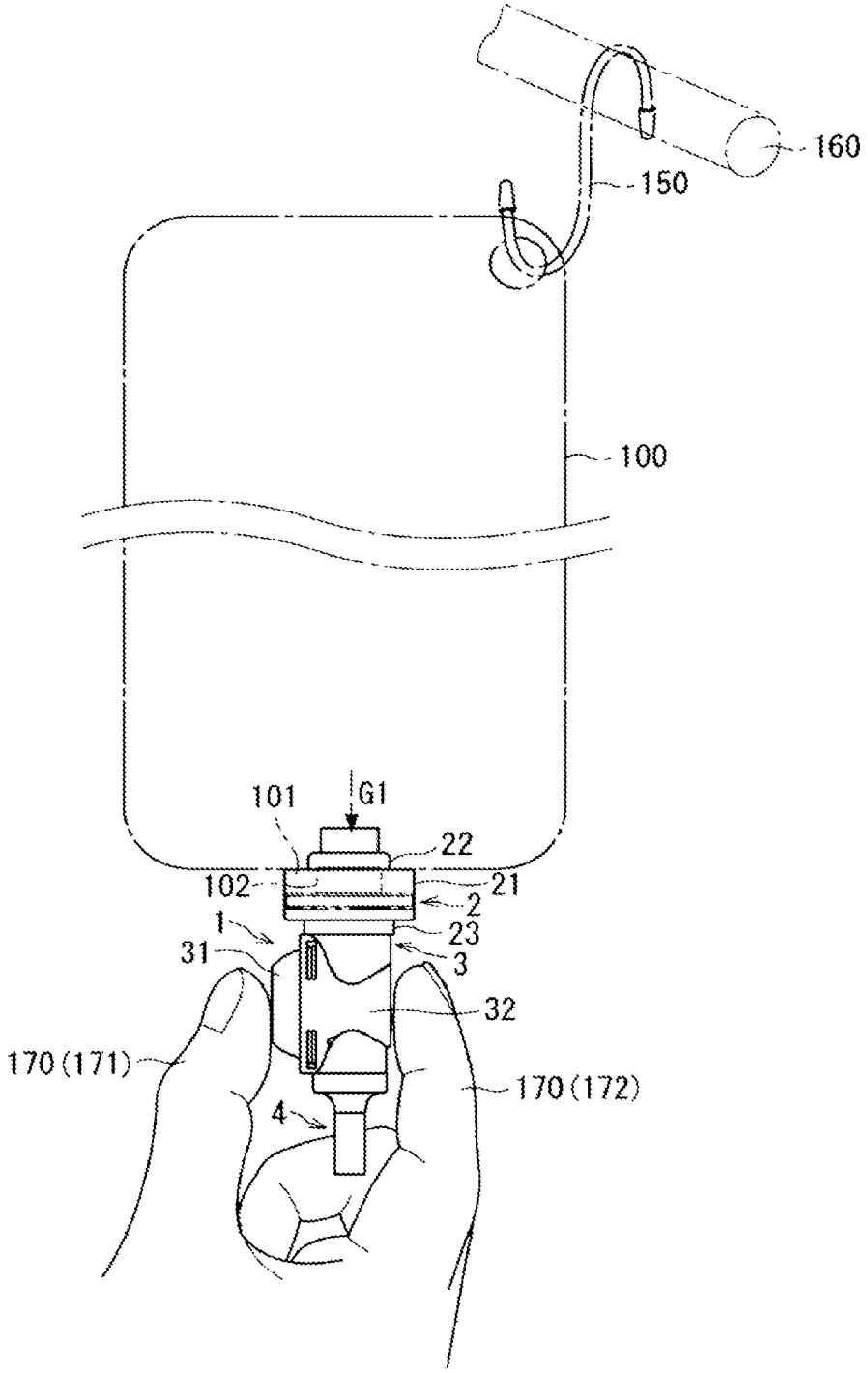
FIG. 4 is a view explaining a usage mode of the dispenser according to the first embodiment.

In the casing 32, a flow path circular in section that penetrates in a diameter direction Y that is a direction intersecting the axial direction X is formed. The diameter direction Y corresponds to a diameter direction of the lid body 31 and the casing 32 when the lid body 31 and the casing 32 are seen from a top portion side of the lid body 31. One end side of the flow path forms a suction path 341, and the other end side of the flow path forms a discharge path 342. The cap portion 2 is fitted onto an outer periphery of the suction path 341. The cap portion 2 includes three cylindrical portions 21, 22, and 23 that have a same axis and different diameters. The cylindrical portion 21 has a screw formed on an inner peripheral side and configures a fitting portion that causes the dispenser 1 to be fitted to a liquid accommodation container 100 by being screwed onto a mouth neck portion 101 by being rotated with respect to the mouth neck portion 101 of a liquid accommodation container 100 formed of a film material, as shown in FIG. 4. The cylindrical portion 22 has an outer periphery of the suction path 341 inserted in an inside thereof as shown in FIG. 1 and FIG. 3 and integrates the cap portion 2 and the pump portion 3 by being welded by laser or the like.

As shown in FIG. 4, the liquid accommodation container 100 is of a type that is used by being suspended on a towel hanger 160, for example, with a hook 150. In the dispenser 1 fitted to the liquid accommodation container 100, the nozzle portion 4 is located downward so that a liquid G1 accommodated in the container is sucked from the liquid accommodation container 100 that is located above the pump. When a discharge operation of holding and pinching the dispenser 1 with fingers 170 (for example, a thumb 171 and a forefinger 172) of a hand of a user is performed, a fixed amount of the liquid G in the pump chamber 30 is discharged from the nozzle portion 4, and when the discharge operation is released, the liquid G1 is sucked into the pump chamber 30 from the inside of the liquid accommodation container 100.

The cylindrical portion 23 is a part that is inserted into the mouth neck portion 101 and located in the liquid accommodation container 100 when the dispenser 1 is fitted to the liquid accommodation container 100, and as shown in FIG. 1 and FIG. 3, an inside thereof is a liquid inflow path 231. In a wall portion 22*a* that is formed in a border between the cylindrical portion 22 and the cylindrical portion 23, a suction port 232 that communicates with the liquid inflow path 231 and the suction path 341 is formed.

Inside the cylindrical portion 22, a suction valve 5 is provided as shown in FIG. 1. The suction valve 5 includes a valve body that opens and closes the suction port 232, and a support portion that supports the valve body with spaces in a circumferential direction and is fitted in a space that is formed between an inner end surface 22*b* of the wall portion 22*a* and an end surface 341*a* of the suction path 341. In other words, the suction valve 5 is held in a state sandwiched by the cap portion 2 and the pump portion 3 from both sides. The suction valve 5 is a resin-molded product. The suction valve 5 is formed to close when internal pressure of the pump chamber 30 increases, and shield the suction port 232 to stop a flow of the liquid into the pump chamber 30 from the liquid accommodation container 100. The suction valve 5 is formed to open when the internal pressure of the pump chamber 30 decreases, and open the suction port 232 to suck a liquid G1 from an inside of the liquid accommodation container 100.

As shown in FIG. 1 and FIG. 3, the discharge path 342 that is located at an opposite side of the suction path 341 is formed to communicate with a cylindrical nozzle fitting portion 343. The nozzle portion 4 is fitted to the nozzle fitting portion 343. The nozzle portion 4 includes a nozzle inner flow path 41 that is formed to penetrate through an inside of the nozzle portion, and a fitting flange 42 for being fitted to the nozzle fitting portion 343. A discharge port 46 is formed in one end portion 41*a* [nozzle tip end 4*a*] of the nozzle inner flow path 41. The other end portion 41*b* of the nozzle inner flow path 41 is formed to communicate with a discharge port 344 that is formed in an end portion of the discharge path 342. In the fitting flange 42, an annular groove 43 including a step portion 44 therein is formed. The cylindrical nozzle fitting portion 343 is inserted in the groove 43. On an outer peripheral surface of the nozzle fitting portion 343, a projection 45 that is engaged with the step portion 44 is formed. The dispenser 1 is formed so that the nozzle fitting portion 343 is inserted into the groove 43 and the step portion 44 and the projection 45 are engaged with each other to thereby prevent a slip of the nozzle portion 4.

Inside the nozzle fitting portion 343, a discharge valve 6 is provided. The discharge valve 6 includes a valve body that opens and closes the discharge port 344, and a support portion that supports the valve body with spaces in the circumferential direction, and is arranged in a space that is formed between the end portion 4*b* of the nozzle portion 4 and an inner end surface 343*a* of the nozzle fitting portion 343. In other words, the discharge valve 6 is held in a state sandwiched by the nozzle portion 4 and the pump portion 3 from both sides. The discharge valve 6 is a resin-molded product. The discharge valve 6 is formed to open and open the discharge port 344 when the internal pressure of the pump chamber 30 increases, and discharge the liquid in the pump chamber 30 to an outside from the discharge port 46 via the nozzle inner flow path 41. The discharge valve 6 is formed to close to close the discharge port 344 when the internal pressure of the pump chamber 30 decreases, and stop a flow of the liquid from the inside of the pump chamber 30 to the nozzle inner flow path 41.

In the dispenser 1, the liquid inflow path 231, the suction port 232, the suction path 341, the discharge path 342, the discharge port 344 and the nozzle inner flow path 41 are arranged in series so that respective centers are located on the same straight line Y1. The straight line Y1 is a nozzle center line.

The lid body 31 is fitted to the casing 32 to cover the opening 33 of the casing 32. The lid body 31 is formed of a material that is elastically deformable. In the lid body 31, a top surface 31*a* that faces an opposite side of the end surface 32*b* of the casing 32 is formed into a substantially flat truncated conical shape. The top surface 31*a* of the lid body 31 and the end surface 32*b* are formed as planes parallel to each other. The lid body 31 is provided to bulge in a direction projecting outward and shown by an arrow Xa (hereinafter, described as "restoration direction Xa") from the casing 32 before the discharge operation (before deformation). The lid body 31 causes the liquid G in the pump chamber 30 to be discharged from the discharge port 46 by performing a discharge operation that presses the lid body 31 toward the inside of the pump chamber 30 with human fingers 170 (see FIG. 4), for example to deform the lid body 31 as shown by an arrow Xb. The direction shown by the arrow Xb that is pressed at the time of the discharge operation will be referred to as "discharge operation direction Xb" hereinafter. When the discharge operation is released, the lid body 31 is restored to the restoration direction Xa, and sucks the liquid G1 into the pump chamber 30 from the liquid accommodation container 100.

Figure 5:
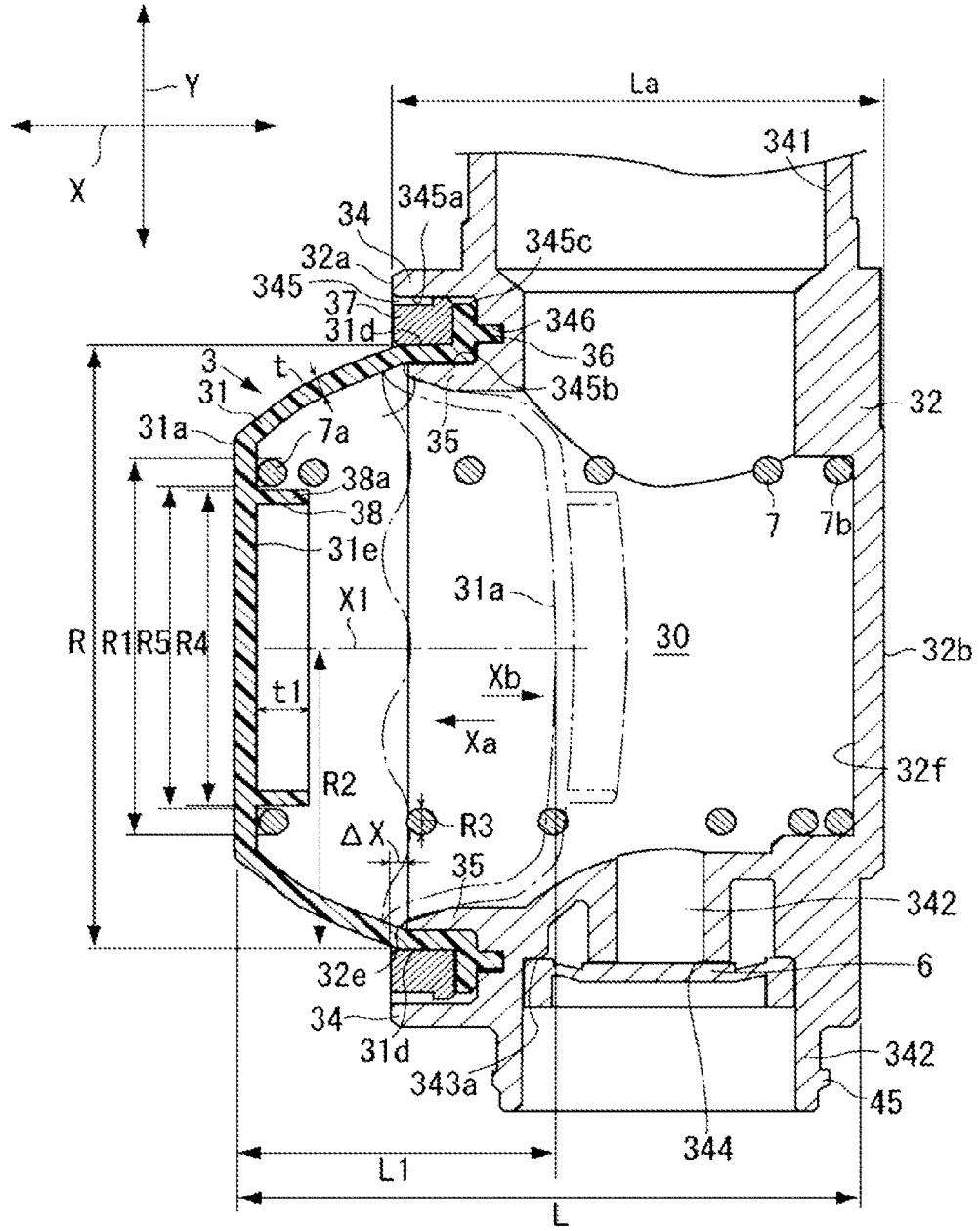
FIG. 5 is an enlarged view explaining a dimensional relationship of a lid body and a coil spring of the dispenser according to the first embodiment.

As shown in FIG. 3, an annular flange portion 31*c* that is projected in the diameter direction Y is formed on an opening side 31*b* of the lid body 31. The flange portion 31*c* is inserted into a circular fitting groove 345 that is formed in the end surface 32*a* of the casing 32 concentrically with the opening 33 from an opening 33 side. As shown in FIG. 5, in the flange portion 31*c*, a lip portion 36 capable of being inserted into a slit portion 346 that is formed in a bottom portion 345*c* of the fitting groove 345 is formed. The flange portion 31*c* and the fitting groove 345 are formed so that the lip portion 36 is inserted into the slit portion 346 when the flange portion 31*c* is fitted in the fitting groove 345. Accordingly, as shown in FIG. 1, the dispenser 1 is configured such that the lip portion 36 occupies an engagement state by insertion into the slit portion 346, and thereby prevents rotation in the circumferential direction of the lid body 31.

As shown in FIG. 1 and FIG. 3, between an annular outside inner wall 345*a* of the fitting groove 345, and an outer surface 31*d* of the lid body 31 facing the outside inner wall 345*a* in a state fitted in the fitting groove 345, a ring-shaped stop member 37 is fitted so as to be in a fitted state. Since the stop member 37 is fitted in the fitting groove 345, the lid body 31 has the flange portion 31*c* pressed against the outside inner wall 345*a*, an inside inner wall 345*b* and the bottom portion 345*c* of the fitting groove 345, as shown in FIG. 1. Accordingly, the lid body 31 is fitted to the casing 32 so as not to remove from the fitting groove 345 even when the lid body 31 is pressed in the discharge operation direction Xb.

As shown in FIG. 1 and FIG. 3, the dispenser 1 includes a coil spring 7 that urges the lid body 31 toward the restoration direction Xa that is the outside of the casing 32, in the pump portion 3 (pump chamber 30). The coil spring 7 is a compression coil spring, one end 7*a* side thereof is placed on a bottom surface 32*f* of the casing 32, and another end 7*b* side is engaged with a spring receiving portion 38 formed on an inner surface 31*e* of the lid body 31, as shown in FIG. 1. The spring receiving portion 38 includes an annular rib 38*a* that is projected toward the inside of the pump chamber 30 from the inner surface 31*e* of the lid body 31.

As shown in FIG. 5, in the dispenser 1 according to the present embodiment, a diameter R1 of the coil spring 7 is formed to be larger than a radius R2 of the lid body 31. A deformation amount L1 of the lid body 31 is equal to or more than ⅓ of the diameter R of the lid body 31. The deformation amount L1 is a distance from the top surface 31*a* of the lid body 31 before deformation to the top surface 31*a* at a time of the lid body 31 being deformed most in the discharge operation direction Xb and is a pump stroke amount. Further, the diameter R of the lid body 31 is a direct distance between the outer surfaces 31*d* of parts facing each other of the lid body 31 in a state where the lid body 31 is fitted in the fitting groove 345 with the stop member 37. The radius R2 of the lid body 31 is half the distance of the diameter R of the lid body 31, and specifically a direct distance from the outer surface 31*d* of the lid body 31 to the center line X1 of the lid body 31. The dispenser 1 is used by being fitted to a lower portion of the liquid accommodation container 100 by being screwed onto the mouth neck portion 101 by rotating the cylindrical portion 21 of the cap portion 2 with respect to the mouth neck portion 101 formed in the lower portion of the liquid accommodation container 100. In the mouth neck portion 101, a discharge port 102 of the liquid accommodation container 100 is formed. A projection amount t1 of the annular rib 38*a* is formed to be longer than a diameter R3 of a wire rod that forms the coil spring 7. A diameter R4 of the annular rib 38*a* is formed to be slightly smaller than an inside diameter R5 of the coil spring 7, so that the coil spring 7 is easily fittable to the annular rib 38*a* at the time of fitting the coil spring 7. The coil spring 7 according to the present embodiment is formed of a wire rod with a diameter R3 that is smaller than the diameter of the wire rod forming an ordinary coil spring with a same diameter.

Further, the coil spring 7 is provided to abut on the inner surface 31*e* corresponding to the top surface 31*a* of the lid body 31. In other words, the coil spring 7 abuts on the inner surface 31*e* that is inside from the edge portion 31*g* of the lid body 31.

In the dispenser 1, as shown in FIG. 5, an inner end portion 32*e* of the casing 32 is formed to be one step lower in the discharge operation direction Xb than the end surface 32*a*. A difference in elevation ΔX along the discharge operation direction Xb between the inner end portion 32*e* and the end surface 32*a* is formed to be a substantially same as a thickness t of the lid body 31, for example. In other words, the inner end portion 32*e* that is an annular edge of the opening 33 is formed to be lower than the end surface 32*a*. Accordingly, the lid body 31 is not bent on the end surface 32*a* but is deformed to the inside of the pump chamber 30 with the inner end portion 32*e* as a starting point of deformation at the time of deformation in the discharge operation direction Xb, so that the lid body 31 can earn a stroke amount corresponding to the thickness t.

As shown in FIG. 5, in the dispenser 1, the casing 32 has an inner cylindrical portion 35 that abuts on an inner surface side of the lid body 31. In the present embodiment, an upper end portion of the inner cylindrical portion 35 is the inner end portion 32*e* of the casing 32. Further, in the dispenser 1, the casing 32 has an outer cylindrical portion 34 that is located outward of the lid body 31. In the present embodiment, an upper end portion of the outer cylindrical portion 34 is the end surface 32*a* of the casing 32. The fitting groove 345 is formed between the inner cylindrical portion 35 and the outer cylindrical portion 34. In other words, the outside inner wall 345*a* of the fitting groove 345 is the inner surface of the outer cylindrical portion 34, and the inside inner wall 345*b* of the fitting groove 345 is the outer surface of the inner cylindrical portion 35.

In the present embodiment, the inner cylindrical portion 35 is formed continuously throughout an entire periphery of the opening 33. Thereby, when a user presses the lid body 31 in the discharge operation direction Xb in the dispenser 1, the lid body 31 deforms to the inside of the pump chamber 30 throughout the entire periphery of the opening 33, with the inner end portion 32*e* of the casing 32 as a starting point of the deformation. Accordingly, at the time of pressing the lid body 31, the lid body 31 can be prevented from being deformed into an unintended shape, and the lid body 31 can be prevented from closing the flow path in the casing 32.

As shown in FIG. 4, in the dispenser 1 according to the present embodiment, after fitting the dispenser 1 to the liquid accommodation container 100, the user nips the pump portion 3 by placing a thumb 171 on the top surface 31*a* of the lid body 31, and placing a forefinger 172 or a middle finger on the end surface 32*b* of the casing 32. Subsequently, when the user presses and pushes the lid body 31 in the discharge operation direction Xb against the repulsive force of the coil spring 7, the pressing force is added to the top surface 31*a* and the lid body 31 starts to deform partially toward the inside of the pump chamber 30 as shown in FIG. 6. Accordingly, the user can firmly hold the top surface 31*a* and the end surface 32*b* with the fingers 170 in an initial stage of the discharge operation.

When the user further pushes the lid body 31 in the discharge operation direction Xb in the holding state, the lid body 31 greatly bends into the pump chamber 30 as shown in FIG. 7. Thereby, a capacity of the pump chamber 30 decreases to increase the chamber internal pressure to stop a flow of the liquid from the suction port 232 with the suction valve 5, whereas the discharge valve 6 opens to open the discharge port 344, and a fixed amount of the liquid G in the pump chamber 30 is discharged from the discharge port 46 via the nozzle inner flow path 41.

When the user loosens the pressing force applied to the lid body 31 to release the discharge operation, the lid body 31 moves toward the restoration direction Xa by the repulsive force of the coil spring 7, and changes to be restored to an original shape before deformation. As a result, the internal pressure of the pump portion 3 decreases, so that the discharge valve 6 is closed to close the discharge port 344, whereas the suction valve 5 is opened to open the suction port 232, and a fixed amount of the liquid G1 in the liquid accommodation container 100 is sucked into the pump portion 3 via the suction port 232 and the suction path 341.

As above, according to the dispenser 1 according to the first embodiment, the diameter R1 of the coil spring 7 that is arranged in the pump portion 3 (pump chamber 30), and urges the lid body 31 in the restoration direction Xa on the casing 32 side is formed to be larger than the radius R2 of the lid body 31, so that a range in which the repulsive force of the coil spring 7 to the inner surface 31*e* of the lid body 31 acts increases. Accordingly, the entire lid body 31 can be easily restored to the initial position before the discharge operation as compared with the case where the lid body 31 is partially restored with the coil spring 7 as in the conventional art. Further, since the deformation amount L1 of the lid body 31 is equal to or more than ⅓ of the diameter R of the lid body 31, a sufficient discharge amount can be secured even if the diameter of the lid body 31 is made smaller.

Thereby, the discharge operation is easy and suction of the liquid into the pump chamber 30 is also favorable, regardless of the amount of discharge in design of the dispenser 1.

Further, since the diameter R3 of the wire rod of the coil spring 7 is formed to be smaller than the diameter of the wire rod that forms an ordinary coil spring with the same diameter, the lid body 31 is deformed to the discharge operation direction Xb with a small force at the time of the discharge operation, and restoration of the lid body 31 that is bent can be performed with a sufficient repulsive force at the time of release of the discharge operation.

Since the edge portion 31*g* is formed at the lid body 31, the user can recognize a position to press (top surface 31*a*) by sense of touch when pressing the lid body 31. Further, since the coil spring 7 is within the top surface 31*a*, the coil spring 7 can reliably be pressed from just above, so that the coil spring 7 can smoothly extend and contract.

Here, a relationship of the diameter R3 of the wire rod that forms the coil spring 7, and the diameter R1 of the coil spring 7 will be described.

A result of the inventor of the present invention investigating the relationship between a diameter of an ordinary coil spring and a diameter of a wire rod is shown in Table 1.

TABLE 1

| Outer diameter of general-purpose coil spring | Wire diameter range |
|---|---|
| Φ10 mm | 0.9-1.4 mm |
| Φ20 mm | 1.2-2 mm |
| Φ25 mm | 2-4 mm |
| Φ32 mm | 2.6-5 mm |

As shown in Table 1, a coil spring is generally required to have a higher repulsive force as the diameter thereof becomes larger, and therefore, the diameter of the wire rod also tends to increase as the spring diameter becomes larger.

However, when the coil spring having such a tendency is to be applied to the dispenser 1, if the repulsive force of the coil spring is selected from the viewpoint of securing restoration of the lid body 31, for example, the repulsive force of the coil spring becomes strong at the time of the discharge operation of the lid body 31, and a large pressing force is required when the discharge operation is performed. In particular, in the case of the dispenser 1 that is used for the liquid accommodation container 100 of a suspension type, the dispenser 1 is often operated by nipping the dispenser 1 with the fingers 170 of one hand, so that a lighter discharge operation is more preferable in the aspect of the operability.

Further, when the repulsive force of the coil spring is strong, it is also assumed that the lid body 31 cannot sufficiently be pressed to the inside of the pump chamber 30 at the time of the discharge operation that presses the lid body 31 into the pump chamber 30. In this case, due to an insufficient stroke amount to be the deformation amount of the lid body 31, a capacity change in the pump chamber 30 is small, and variations in the discharge amount and the suction amount of the liquid are caused.

Consequently, as the coil spring 7 that is used in the dispenser 1 according to the present invention, a ratio of the diameter R1 of the coil spring to the diameter R3 of the wire rod (R1/R3) is preferably 10 or more and 30 or less as a coil spring with equal pitches, and is more preferably 12 or more and 25 or less from a viewpoint of operability at the time of the discharge operation. Showing an example of the coil spring that satisfies the condition, there are cited a coil spring with an outside diameter of 15 mm and a wire diameter of 1 mm, and a coil spring with an outside diameter of 32 mm and a wire diameter of 1.6 mm. The ratio is more preferably 15 or more and 20 or less from viewpoints of the discharge amount [stroke amount] of the liquid that is discharged in one discharge operation and operability at the time of the discharge operation.

In the dispenser 1 according to the first embodiment, a compact dispenser is assumed, in which a diameter R of the lid body 31 is 15 mm to 45 mm, and a height L of the pump portion 3 is 10 mm to 40 mm. Further, as for the deformation amount L1 of the lid body 31, the lid body 31 is formed to be deformable so that the deformation amount L1 is preferably equal to or more than ⅓, and more preferably ½ with respect to the diameter R of the lid body 31. In the present embodiment, the diameter R of the lid body 31 of the dispenser 1 is preferably equal to or more than 15 mm, more preferably equal to or more than 20 mm, preferably equal to or less than 45 mm, more preferably equal to or less than 25 mm, preferably 15 mm or more and 45 mm or less, and more preferably 20 mm or more and 25 mm or less. Note that the diameter R of the lid body 31 is desirably determined in consideration of the diameter of the casing 32. In this case, the deformation amount L1 [stroke amount] of the lid body 31 is preferably 5 mm or more and 20 mm or less.

Further, the deformation amount L1 of the lid body 31 also differs depending on the material used for the lid body 31. The lid body 31 according to the present embodiment is preferably formed of an elastically deformable material, for example, a rubber material such as a synthetic rubber such as a silicone rubber, or a natural rubber.

In the dispenser 1, a distance D1 from the upper end portion 32*e* of the inner cylindrical portion 35 of the casing 32 to the inner surface 31*e* of a top surface portion of the lid body 31 is preferably longer than a distance D2 from the upper end portion 32*e* of the inner cylindrical portion 35 to the coil spring 7. The distance D1 is a distance in the axial direction X. The distance D2 is a shortest distance in the orthogonal direction Y from the upper end portion 32*e* of the inner cylindrical portion 35 to the coil spring 7. By making a relationship of the distance D1 and the distance D2 as described above, the repulsive force of the coil spring 7 is easily transmitted to the bulging curved surface 31*f* of the lid body 31, in particular, a lower end portion of the bulging curved surface 31*f*, and the lid body 31 is more easily restored. From a viewpoint of causing such an effect to be exhibited more remarkably, the ratio of the distance D1 to the distance D2 (D1/D2) is preferably equal to or more than 1, more preferably equal to or more than 1.2, preferably equal to or less than 3, more preferably equal to or less than 2, preferably 1 or more and 3 or less, and more preferably 1.2 or more and 2 or less. In the dispenser 1, the distance D1 is preferably longer than the distance D2 throughout the entire periphery of the inner cylindrical portion 35.

The distance D1 is preferably equal to or more than 2 mm, more preferably equal to or more than 5 mm, preferably equal to or less than 10 mm, more preferably equal to or less than 7 mm, preferably 2 mm or more and 10 mm or less, and more preferably 5 mm or more and 7 mm or less.

The distance D2 is preferably equal to or more than 1 mm, more preferably equal to or more than 2.5 mm, preferably equal to or less than 7 mm, more preferably equal to or less than 4.5 mm, preferably 1 mm or more and 7 mm or less, and more preferably 2.5 mm or more and 4.5 mm or less.

Second Embodiment

A dispenser 1A according to a second embodiment of the present invention will be described with use of FIG. 8 to FIG. 13. Note that hereinafter explanation will be made by assigning the same functions and the same members as those in the first embodiment with the same reference signs, and properly omitting or simplifying explanation on these members.

Figure 8:
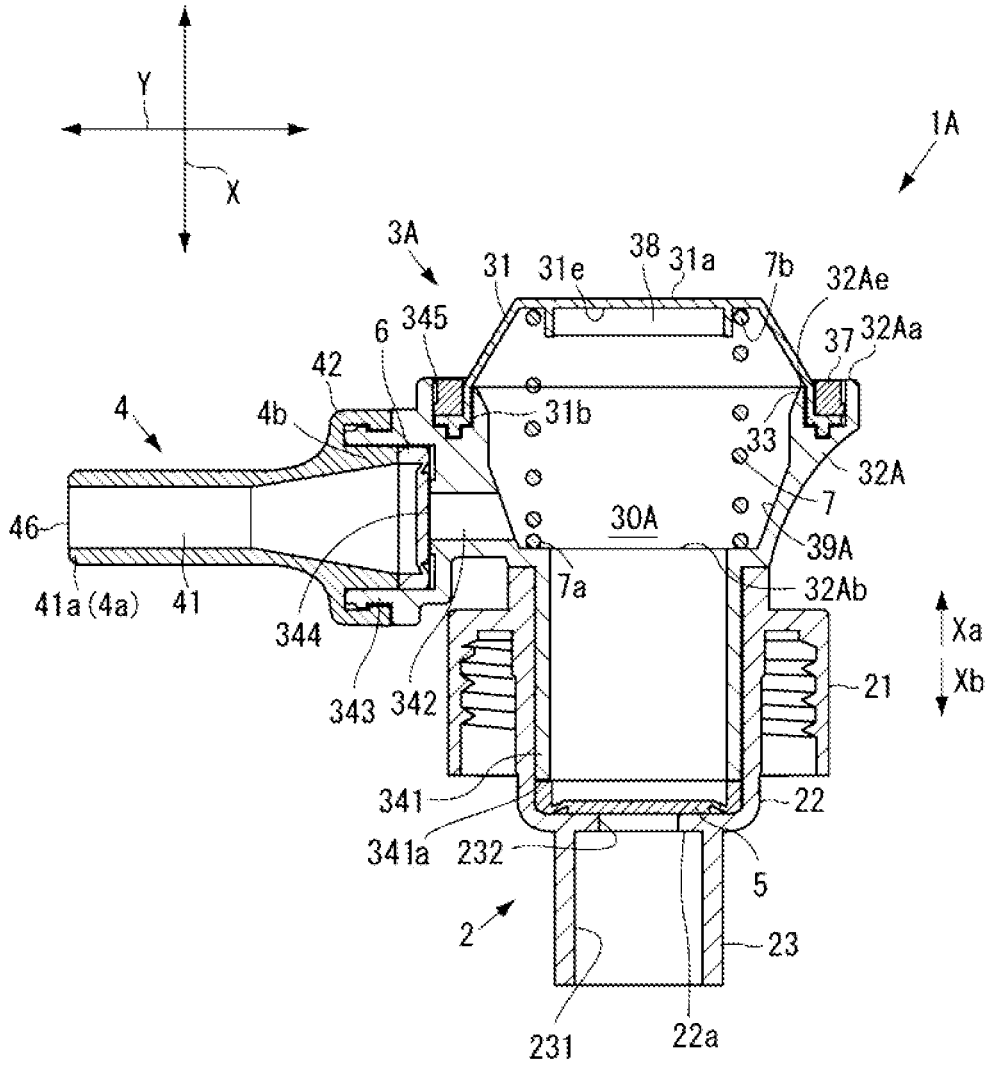
FIG. 8 is a sectional view explaining a configuration and a state before a discharge operation of a dispenser according to a second embodiment of the present invention.
Figure 9:
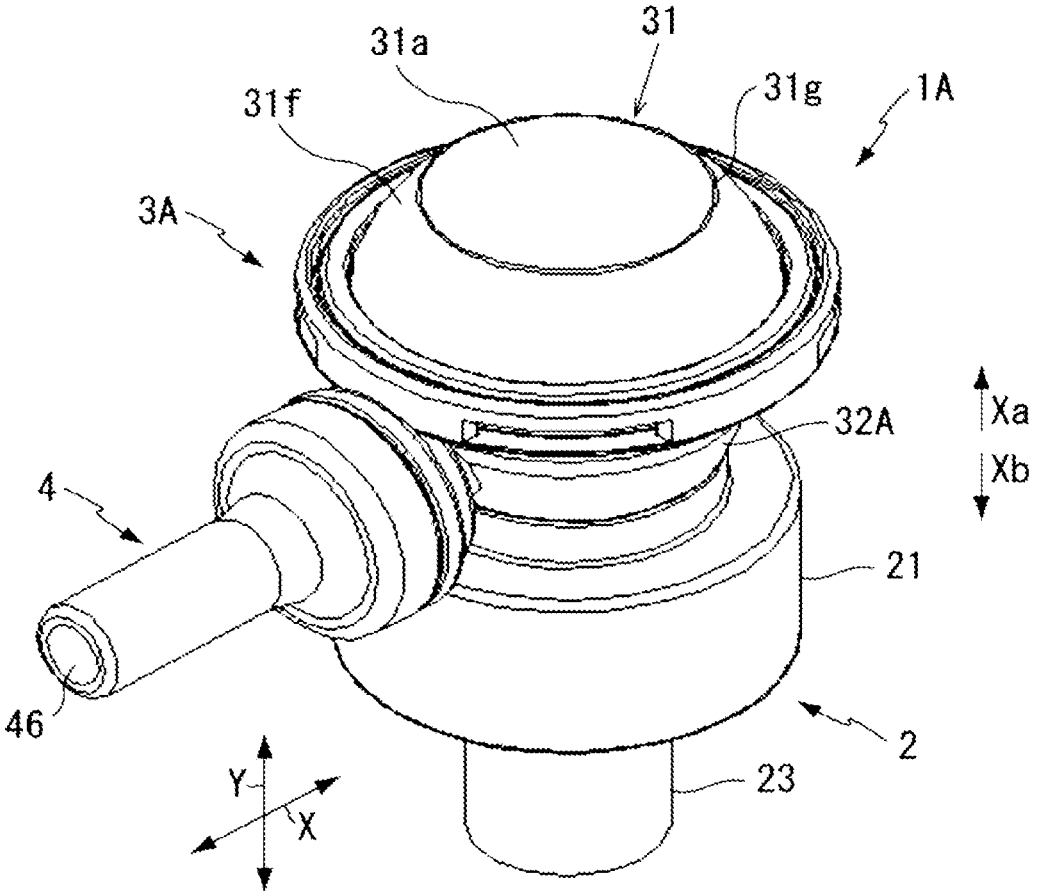
FIG. 9 is a perspective view explaining the configuration of the dispenser according to the second embodiment.
Figure 10:
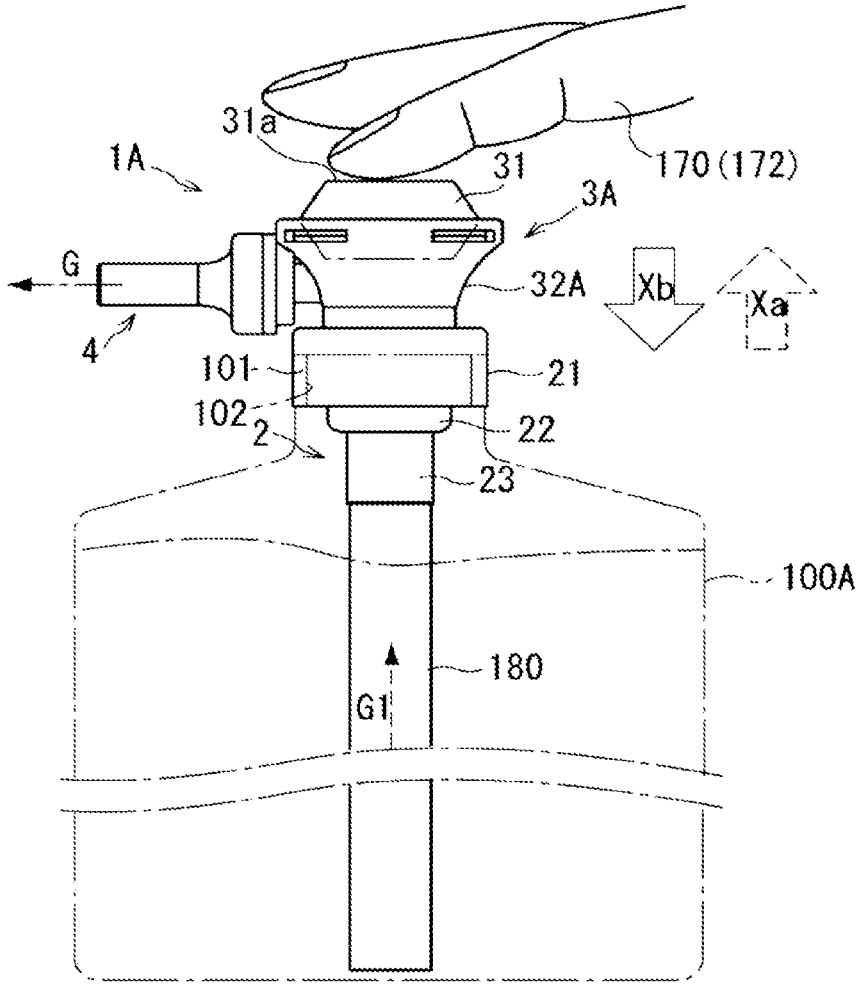
FIG. 10 is a view explaining a usage mode of the dispenser according to the second embodiment.

The dispenser 1A according to the second embodiment includes a cap portion 2, a pump portion 3A, and a nozzle portion 4 as shown in FIG. 8, FIG. 9, and FIG. 10. These members are arranged in series on the same nozzle straight line Y1 in the dispenser 1 according to the first embodiment, but in the dispenser 1A according to the present embodiment, the cap portion 2 and the nozzle portion 4 are arranged in a direction orthogonal to the pump portion 3A, and are fitted to a casing 32A configuring the pump portion 3A. As shown in FIG. 10, the dispenser 1A is used by being fitted to an upper portion of a liquid accommodation container 100A by being screwed onto a mouth neck portion 101 by rotating a cylindrical portion 21 of the cap portion 2 with respect to the mouth neck portion 101 that is formed on the upper portion of the self-supporting liquid accommodation container 100A.

As shown FIG. 8, in the dispenser 1A, a lid body 31 is fitted to cover an opening 33 that is formed in an upper portion of the casing 32A having a depression 39A therein. In the pump portion 3A, the lid body 31 and the casing 32A form a pump chamber 30A. In the dispenser 1A, a fixed amount of liquid in the pump chamber 30A is discharged from the nozzle portion 4 by performing a discharge operation that presses the lid body 31 in a discharge operation direction Xb to a lower part from an upper part in the drawing, and the liquid is sucked into the pump chamber 30A from the inside of the liquid accommodation container 100A by releasing the discharge operation. Here, an operation of a user pushing the lid body 31 of the pump portion 3A downward with fingers 170 refers to the discharge operation.

A difference between the pump portion 3 and the pump portion 3A is a shape of the casing 32A. As shown in FIG. 8, in the cylindrical casing 32A, a suction path 341 is formed in a lower portion thereof with an end surface 341*a* facing downward, and on a left side, a discharge path 342 is formed with a discharge port 344 facing left. In other words, the casing 32A forms an L-shape in section. The cap portion 2 is integrated with the pump portion 3A by inserting the suction path 341 into the cylindrical portion 22. A lifting pipe 180 that is inserted into the liquid accommodation container 100A is connected to a cylindrical portion 23 as shown in FIG. 10, so that the dispenser 1A can draw up a liquid G1 in the container from below the container when the dispenser 1A is fitted to the liquid accommodation container 100A.

As shown in FIG. 8, a suction port 232 that is formed in a wall portion 22*a* in a border of the cylindrical portion 22 and the cylindrical portion 23 communicates with a liquid inflow path 231 and the suction path 341 that extend in an up-down direction, and is opened and closed by a suction valve 5 arranged between the cylindrical portion 22 and the suction path 341. The discharge path 342 extending in a diameter direction Y is formed to communicate with a nozzle inner flow path 41 of the nozzle portion 4 that is fitted to a nozzle fitting portion 343 via the discharge port 344. Between the discharge path 342 and the nozzle portion 4, a discharge valve 6 that opens and closes the discharge port 344 is arranged.

The lid body 31 is formed of an elastically deformable material as in the first embodiment, and is provided to bulge in a restoration direction Xa from the casing 32A before a discharge operation (before deformation). The lid body 31 causes a liquid inside the pump chamber 30A to be discharged to the outside from a discharge port 46 of the nozzle portion 4 by performing a discharge operation that deforms the lid body 31 by pressing the lid body 31 to the discharge operation direction Xb with a human finger 170 (see FIG. 10) or a palm. The lid body 31 draws up the liquid from the liquid accommodation container 100A and cause the liquid to flow into the pump chamber 30A when the discharge operation is released.

A flange portion 31*c* that is formed on an opening side 31*b* of the lid body 31 is inserted into a circular fitting groove 345 that is formed in the casing 32A concentrically with the opening 33 from an opening 33 side. The lid body 31 is fixed to the casing 32 so that the lid body 31 is not removed from the fitting groove 345 even when the lid body 31 is pressed in the discharge operation direction Xb, by a ring-shaped stop member 37 being fitted in the fitting groove 345 in a state where the flange portion 31*c* is inserted in the fitting groove 345.

Figure 11:
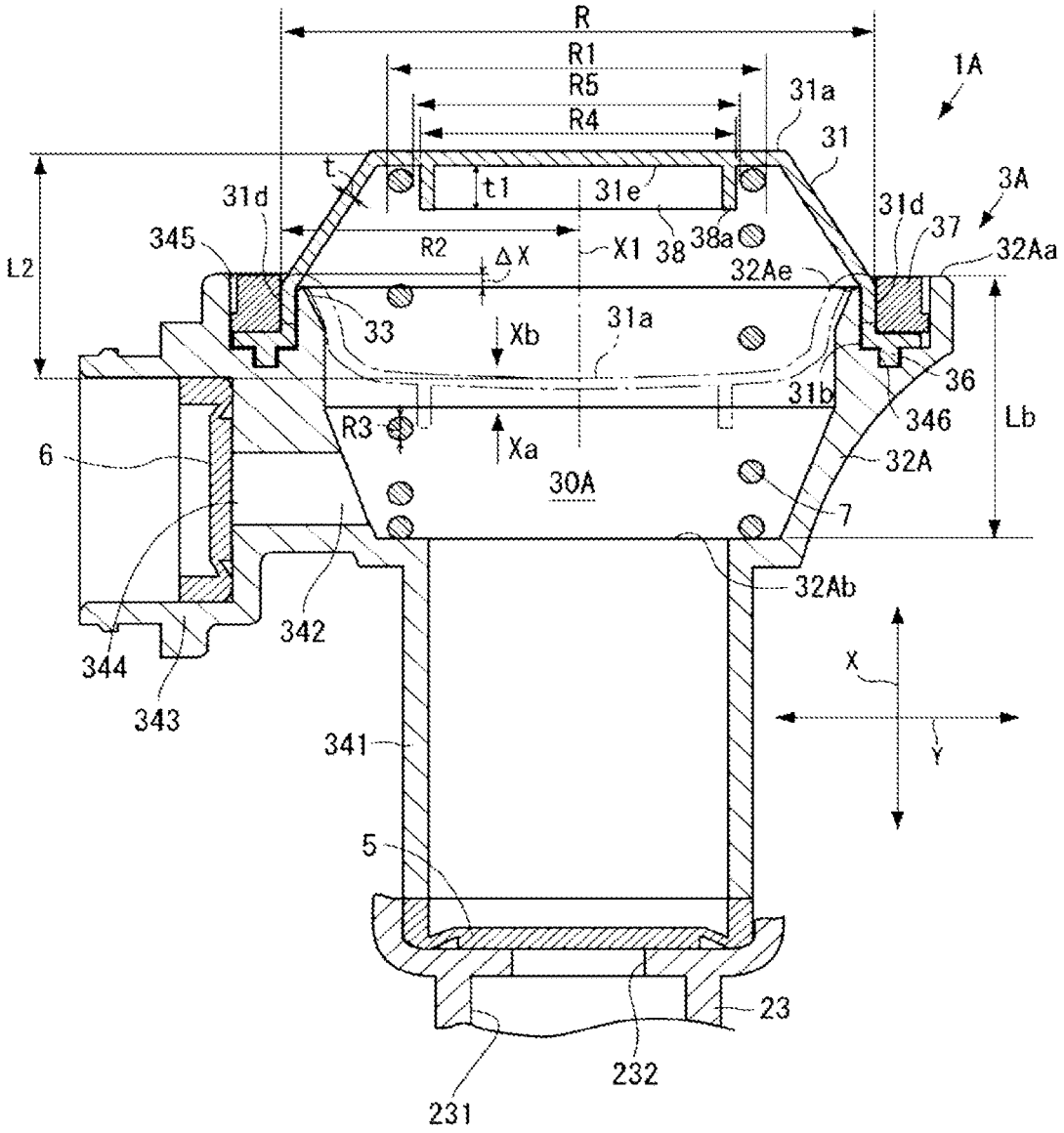
FIG. 11 is an enlarged view explaining a dimensional relationship between a lid body and a coil spring of the dispenser according to the second embodiment.

In the flange portion 31*c* and the fitting groove 345, a lip portion 36 and a slit portion 346 are respectively formed as shown in FIG. 11, as in the first embodiment. The lip portion 36 is inserted into the slit portion 346 when the flange portion 3*c* is fitted in the fitting groove 345, and thereby rotation in a circumferential direction of the lid body 31 is stopped.

The dispenser 1A includes a coil spring 7 that urges the lid body 31 to the restoration direction Xa that is outside of the casing 32A, in the pump portion 3A (pump chamber 30A). The coil spring 7 is a compression coil spring with equal pitches similarly to the coil spring 7 described in the first embodiment, one end 7*a* side thereof is placed on a bottom surface 32Ab of the casing 32A, and the other end 7*b* side is engaged with a spring receiving portion 38 formed on an inner surface 31*e* of the lid body 31.

As shown in FIG. 11, in the present embodiment, a diameter R1 of the coil spring 7 is also formed to be larger than a radius R2 of the lid body 31. A deformation amount L2 of the lid body 31 is equal to or more than ⅓ of a diameter R of the lid body 31. The deformation amount L2 is a distance from the top surface 31*a* of the lid body 31 before deformation to the top surface 31*a* at the time of the lid body 31 being most deformed in the discharge operation direction Xb and is a pump stroke amount. Further, the diameter R of the lid body 31 is a direct distance between outer surfaces 31*d* of parts that face each other of the lid body 31, in a state where the lid body 31 is fitted in the fitting groove 345 with the stop member 37. A protrusion amount t1 of an annular rib 38*a* is formed to be longer than a diameter R3 of a wire rod of the coil spring 7. A diameter R4 of the annular rib 38*a* is formed to be slightly smaller than an inside diameter R5 of the coil spring 7, so that the coil spring 7 is easily fittable to the annular rib 38*a* at a time of fitting the coil spring 7. The coil spring 7 according to the present embodiment is formed of a wire rod with the diameter R3 which is smaller than the diameter of the wire rod that forms an ordinary coil spring with a same diameter. In other words, a ratio of the diameter R1 of the coil spring to the diameter R3 of the wire rod forming the coil spring 7 (R1/R3) is 10 or more and 20 or less.

As shown in FIG. 8 and FIG. 11, in the dispenser 1A, an inner end portion 32Ae of the casing 32A is formed to be one step lower in the discharge operation direction Xb than an end surface 32Aa. A difference in elevation ΔX along the discharge operation direction Xb between the inner end portion 32Ae and the end surface 32Aa is formed to be substantially the same as a thickness t of the lid body 31, for example. In other words, the inner end portion 32Ae to be an annular edge of the opening 33 is formed to be lower than the end surface 32Aa. Accordingly, the lid body 31 is not bent on the end surface 32Aa at the time of deformation in the discharge operation direction Xb, but is deformed to the inside of the pump chamber 30A with the inner end portion 32Ae as a starting point of the deformation, and therefore can earn a stroke amount corresponding to the thickness t.

Figure 12:
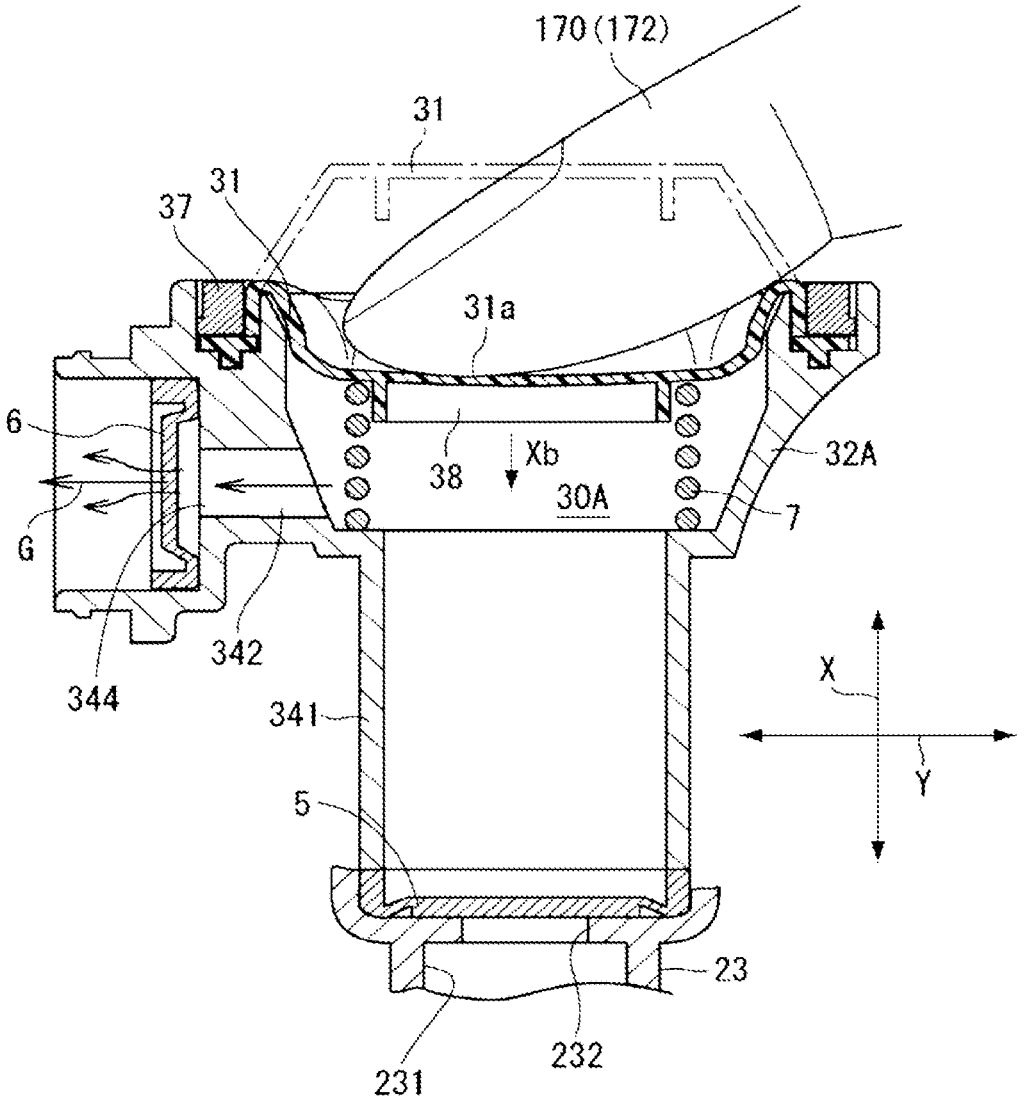
FIG. 12 is a sectional view explaining a state after the discharge operation of the dispenser according to the second embodiment.

When a thick part of a finger 170 (forefinger 172), for example, is placed on the top surface 31*a* of the lid body 31 and presses the lid body 31 in the discharge operation direction Xb against a repulsive force of the coil spring 7 as shown in FIG. 12 after the dispenser 1A is fitted to the liquid accommodation container 100A, a pressing force is applied to the entire lid body from the top surface 31*a* and the lid body is bent toward the inside of the pump chamber 30A. As a result, a capacity in the pump chamber 30A decreases to increase the pressure in the chamber to stop a flow of the liquid from the suction port 232 with the suction valve 5, the discharge valve 6 opens to open the discharge port 344, and a fixed amount of the liquid G in the pump chamber 30A is discharged from the discharge port 46 via a nozzle inner flow path 41.

Figure 13:
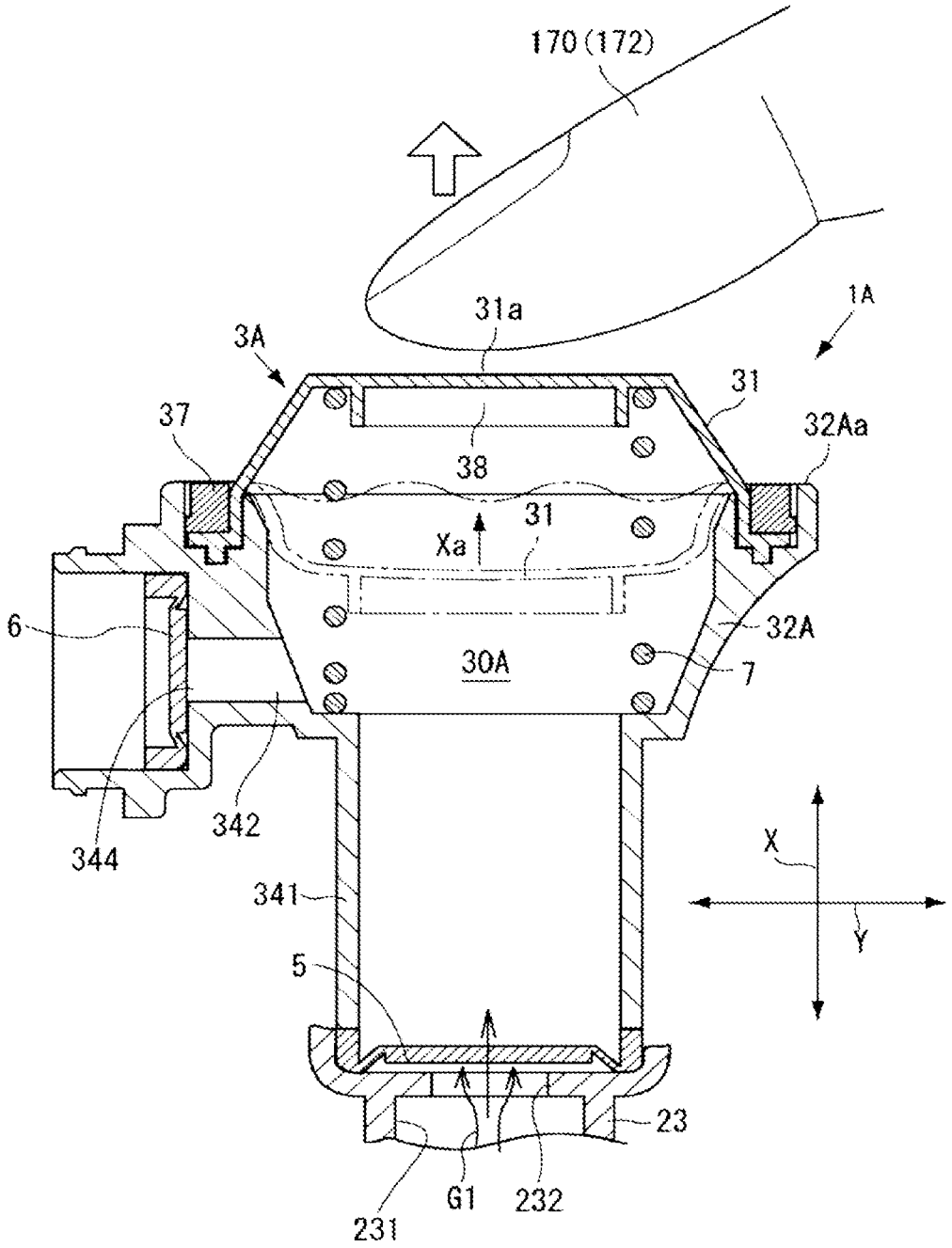
FIG. 13 is a sectional view explaining a state restored from the state after the discharge operation of the dispenser according to the second embodiment.

When the user loosens the pressing force applied to the lid body 31 to release the discharge operation, the lid body 31 moves to the restoration direction Xa by the repulsive force of the coil spring 7 as shown in FIG. 13, and changes to be restored to an original shape before deformation. Since the internal pressure of the pump chamber 30A decreases as a result, the discharge valve 6 is closed to close the discharge port 344, and the suction valve 5 is opened to open the suction port 232, so that a fixed amount of the liquid G1 in the liquid accommodation container 100A is sucked into the pump chamber 30A via the suction port 232 and the suction path 341.

As above, in the dispenser 1A according to the present embodiment, the diameter R1 of the coil spring 7 that is arranged in the pump chamber 30A, and urges the lid body 31 in the restoration direction Xa that is on the casing 32A side is formed to be larger than the radius R2 of the lid body 31, and therefore, a range in which the repulsive force of the coil spring 7 to the inner surface 31*e* of the lid body 31 acts also increases. Accordingly, the entire lid body can be moved and restored to the initial position before the discharge operation as compared with the case where the lid body 31 is partially restored with the coil spring 7 as in the conventional art. Accordingly, regardless of the amount of discharge in design of the dispenser 1A, the discharge operation is easy, and suction of the liquid into the pump chamber 30A is also favorable.

Further, since the diameter R3 of the wire rod of the coil spring 7 is formed to be smaller than the diameter of the wire rod that forms an ordinary coil spring with the same diameter, the lid body 31 is deformed to the discharge operation direction Xb with a small force at the time of the discharge operation, and restoration of the lid body 31 that is bent can be performed with a sufficient repulsive force at the time of release of the discharge operation.

Third Embodiment

A dispenser 1B according to a third embodiment of the present invention will be described with use of FIG. 14 to FIG. 18.

Figure 14:
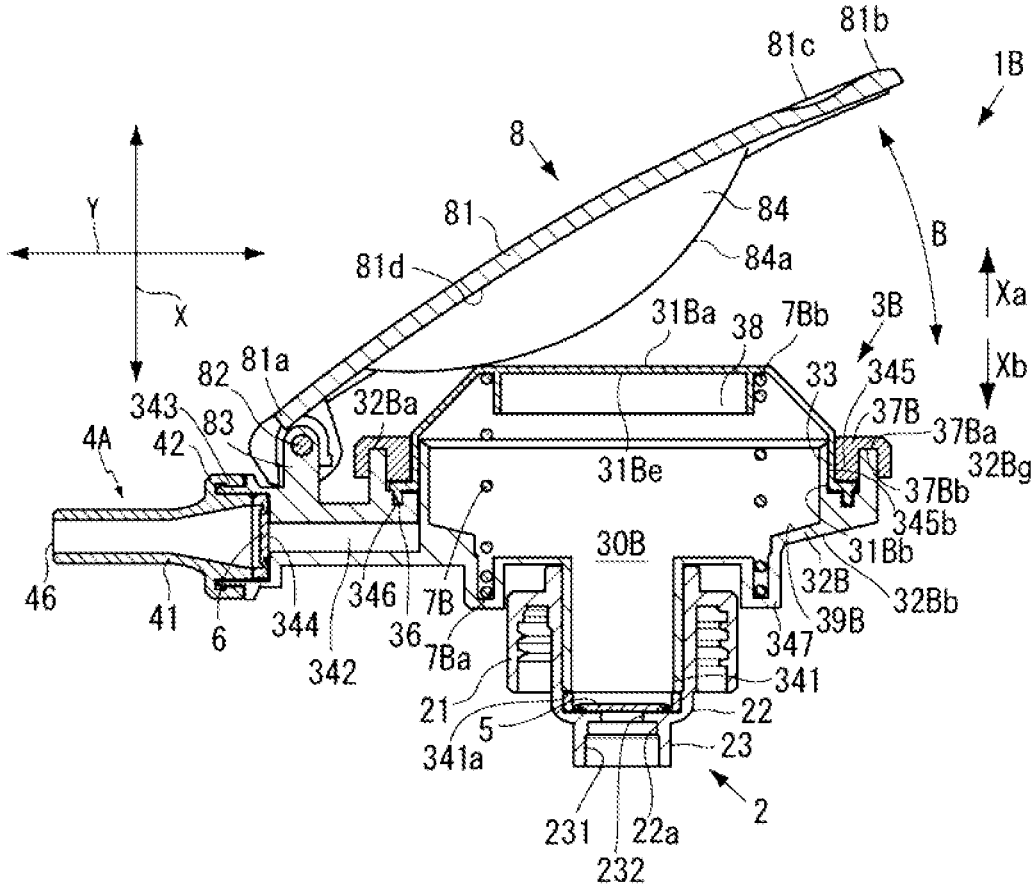
FIG. 14 is a sectional view explaining a configuration and a state before a discharge operation of a dispenser according to a third embodiment of the present invention.
Figure 15:
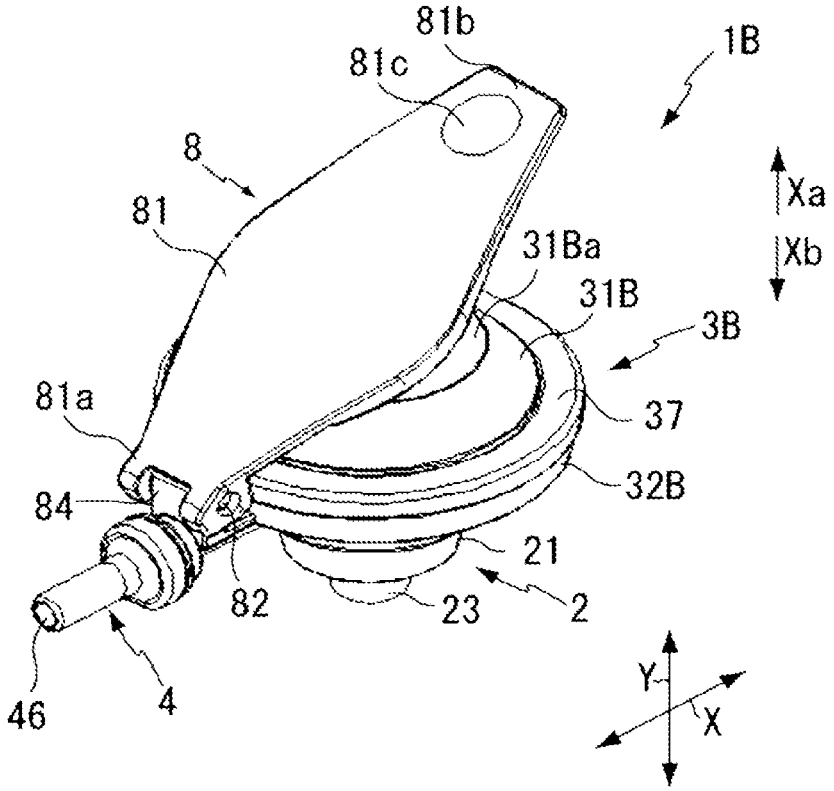
FIG. 15 is a perspective view explaining the configuration of the dispenser according to the third embodiment.
Figure 16:
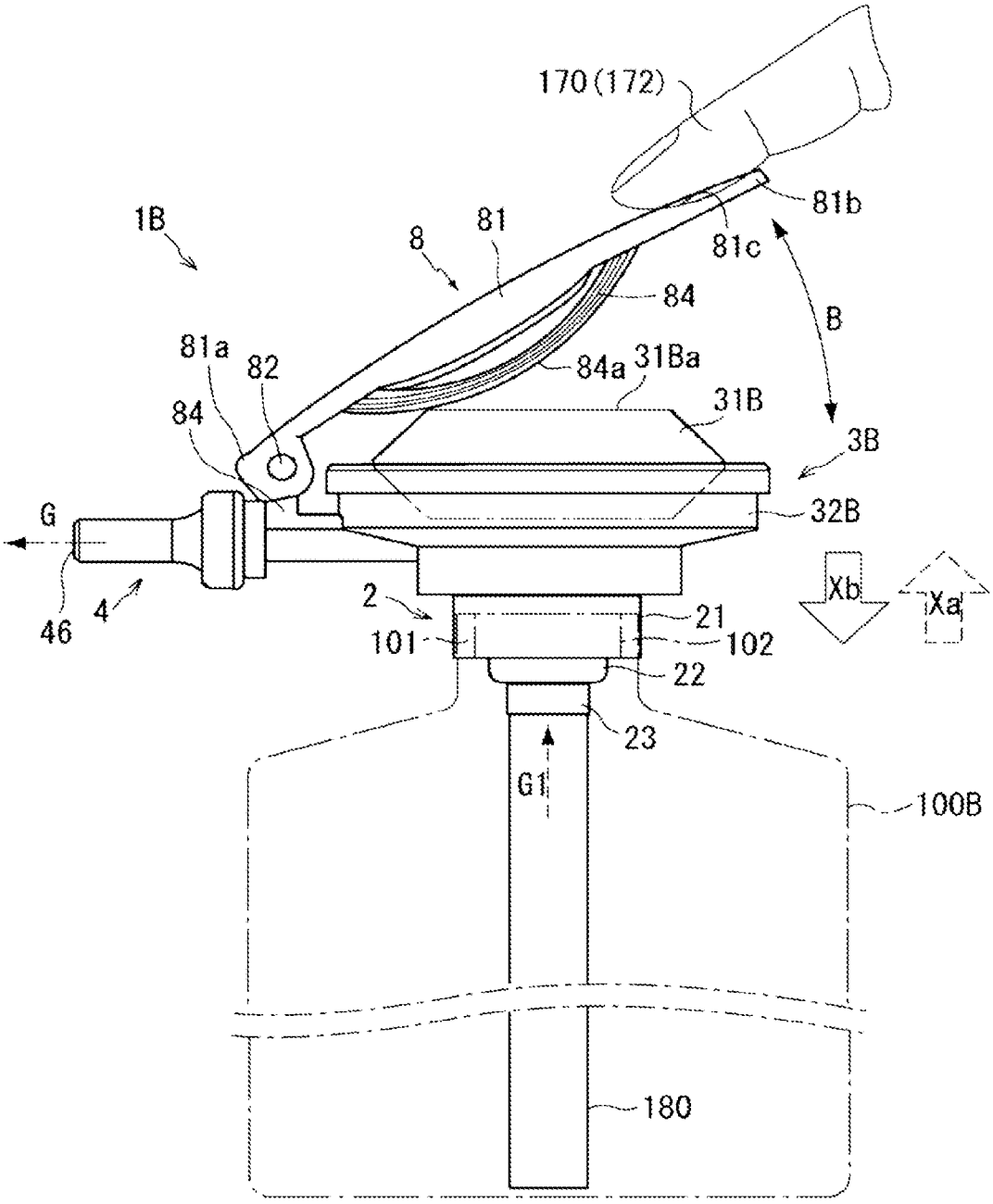
FIG. 16 is a view explaining the configuration and a usage mode of the dispenser according to the third embodiment.

The dispenser 1B according to the third embodiment includes a pressing portion 8 as well as a cap portion 2, a pump portion 3B, and a nozzle portion 4A, as shown in FIG. 14, FIG. 15 and FIG. 16. The cap portion 2 and the nozzle portion 4A are arranged in directions orthogonal to the pump portion 3B as in the second embodiment and are fitted to a casing 32B configuring the pump portion 3B. As shown in FIG. 16, the dispenser 1B is used by being fitted to an upper portion of a liquid accommodation container 100B by being screwed onto a mouth neck portion 101 by rotating a cylindrical portion 21 of the cap portion 2 with respect to the mouth neck portion 101 formed on the upper portion of the self-supporting liquid accommodation container 100B. In the mouth neck portion 101, a discharge port 102 of the liquid accommodation container 100B is formed.

As shown in FIG. 14, in the dispenser 1B, a lid body 31B is fitted so as to cover an opening 33 that is formed in an upper portion of the casing 32B as a body having a depression 39B inside. In the pump portion 3B, a space enclosed by the lid body 31B and the casing 32B is formed as a pump chamber 30B. In the dispenser 1B, a fixed amount of a liquid G in the pump chamber 30B is discharged from a nozzle portion 4A by performing a discharge operation that presses the lid body 31B in a discharge operation direction Xb by the pressing portion 8, and the liquid G1 is sucked into the pump chamber 30B from the inside of the liquid accommodation container 100B by releasing the discharge operation by the pressing portion 8. Here, pressing the lid body 31B in the discharge operation direction Xb by the pressing portion 8 is referred to as the discharge operation.

Differences between the dispenser 1A described above and the dispenser 1B according to the present embodiment are a configuration of the pump portion 3B and inclusion of the pressing portion 8. Differences between the pump portion 3A and the pump portion 3B are that the casing 32B is larger in diameter and flatter than the casing 32A, a diameter RB of the lid body 31B is larger than the diameter of the lid body 31, a capacity of the pump chamber 30B is large and a discharge amount of a liquid per one time is large. Hereinafter, the differences will be mainly described.

As shown in FIG. 14, in the cylindrical casing 32B, a suction path 341 is formed in a lower portion thereof with an end surface 341*a* facing downward, and a discharge path 342 is formed in a left side portion with a discharge port 344 facing left. In other words, the casing 32B forms an L-shape in section. The cap portion 2 is integrated with the pump portion 3B by inserting the suction path 341 in a cylindrical portion 22. As shown in FIG. 16, a lifting pipe 180 that is inserted into the liquid accommodation container 100B is connected to a cylindrical portion 23, so that the dispenser 1B can draw up the liquid G1 in the container from a lower part of the container when fitted to the liquid accommodation container 100B.

As shown in FIG. 14, a suction port 232 that is formed in a wall portion 22*a* in a border of the cylindrical portion 22 and the cylindrical portion 23 communicates with a liquid inflow path 231 and the suction path 341, and is opened and closed by a suction valve 5 that is arranged between the cylindrical portion 22 and the suction path 341. The discharge path 342 is formed to communicate with a nozzle inner flow path 41 in the nozzle portion 4A that is fitted to a nozzle fitting portion 343 via a discharge port 344. A discharge valve 6 that opens and closes the discharge port 344 is arranged between the discharge path 342 and the nozzle portion 4A. On an outer peripheral side of the suction path 341, an annular groove portion 347 is formed to protrude downward from a bottom surface 32Bb of the casing 32B.

The lid body 31B is formed of a material contractable and restorable, and is provided to bulge in a restoration direction Xa from the casing 32B before a discharge operation (before deformation), as in the first and second embodiments. The lid body 31B causes the liquid in the pump chamber 30B to be discharged from a discharge port 46 of the nozzle portion 4A by performing a discharge operation that presses the lid body 31B to the discharge operation direction Xb with the pressing portion 8 to deform the lid body 31B. The lid body 31B draws up the liquid G1 from the liquid accommodation container 100B to cause the liquid G1 to flow into the pump chamber 30B when the discharge operation is released.

A flange portion 31Bc formed on an opening side 31Bb of the lid body 31B is inserted into a circular fitting groove 345 that is formed in the casing 32B concentrically with the opening 33 from an opening 33 side. The lid body 31B is fixed to the casing 32B so as not to be removed from the fitting groove 345 even when being pressed in the discharge operation direction Xb, by a ring-shaped stop member 37B being fitted to the casing 32B in a state where the flange portion 31*c* is inserted in the fitting groove 345. The stop member 37B forms a U-shape in section and is fitted across the fitting groove 345 and an outer peripheral surface 32Bg of the casing 32B by covering an end surface 32Ba of the casing 32B with a recessed portion 37Bb.

In the flange portion 31Bc and the fitting groove 345, a lip portion 36 and a slit portion 346 are respectively formed as in the first embodiment. The lip portion 36 is inserted into the slit portion 346 when the flange portion 31Be is fitted into the fitting groove 345, and thereby rotation in a circumferential direction of the lid body 31B is stopped.

The dispenser 1B includes a coil spring 7B that urges the lid body 31B to the restoration direction Xa that is outside of the casing 32B, in the pump portion 3B (pump chamber 30B). The coil spring 7B is a compression coil spring with equal pitches, one end 7Ba side thereof is inserted into the groove portion 347 formed in the casing 32B, and another end 7Bb side is engaged with a spring receiving portion 38 formed on an inner surface 31Be of the lid body 31B.

Figure 17:
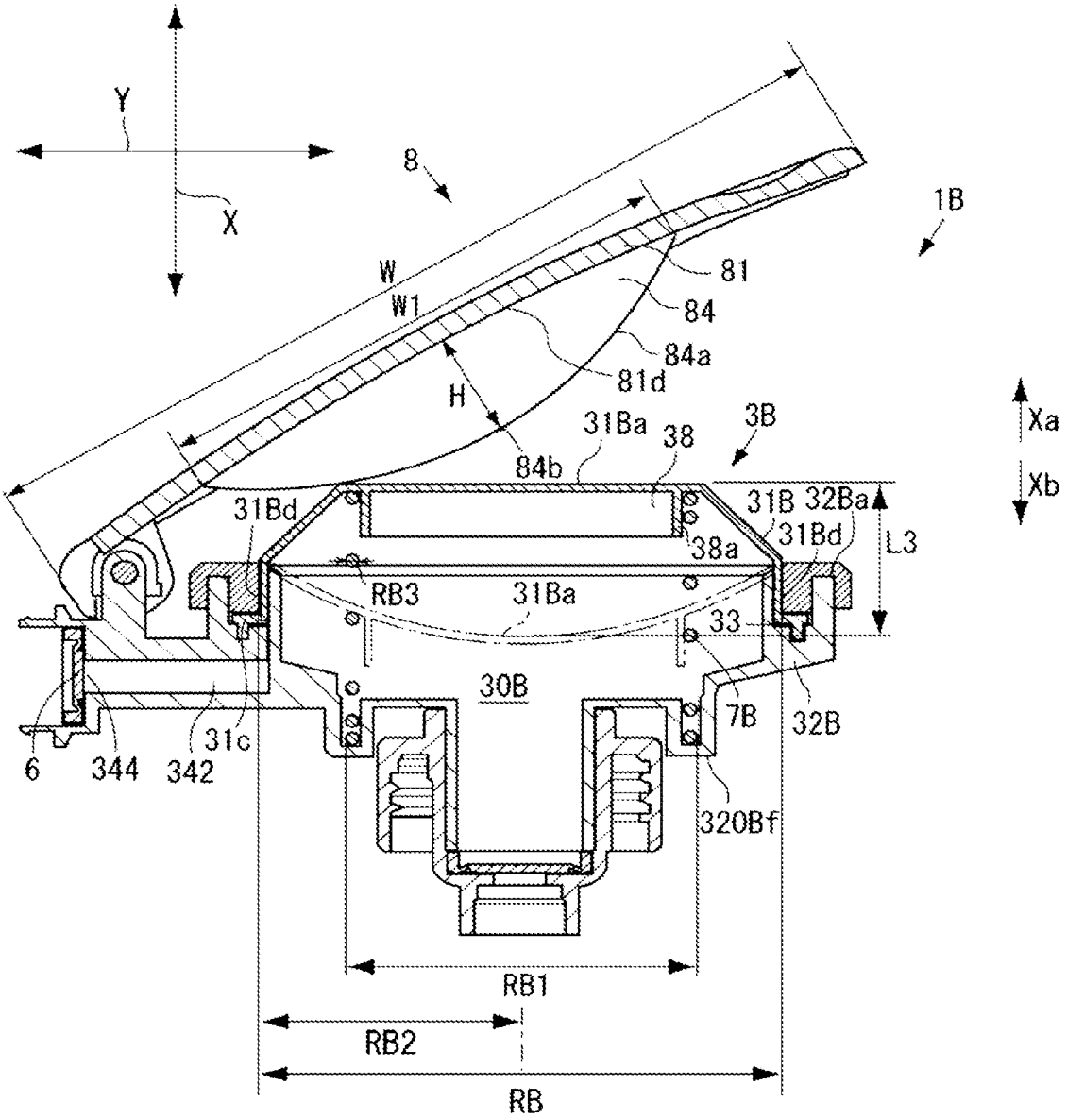
FIG. 17 is an enlarged view explaining a dimensional relationship between a lid body and a coil spring of the dispenser according to the third embodiment.
Figure 18:
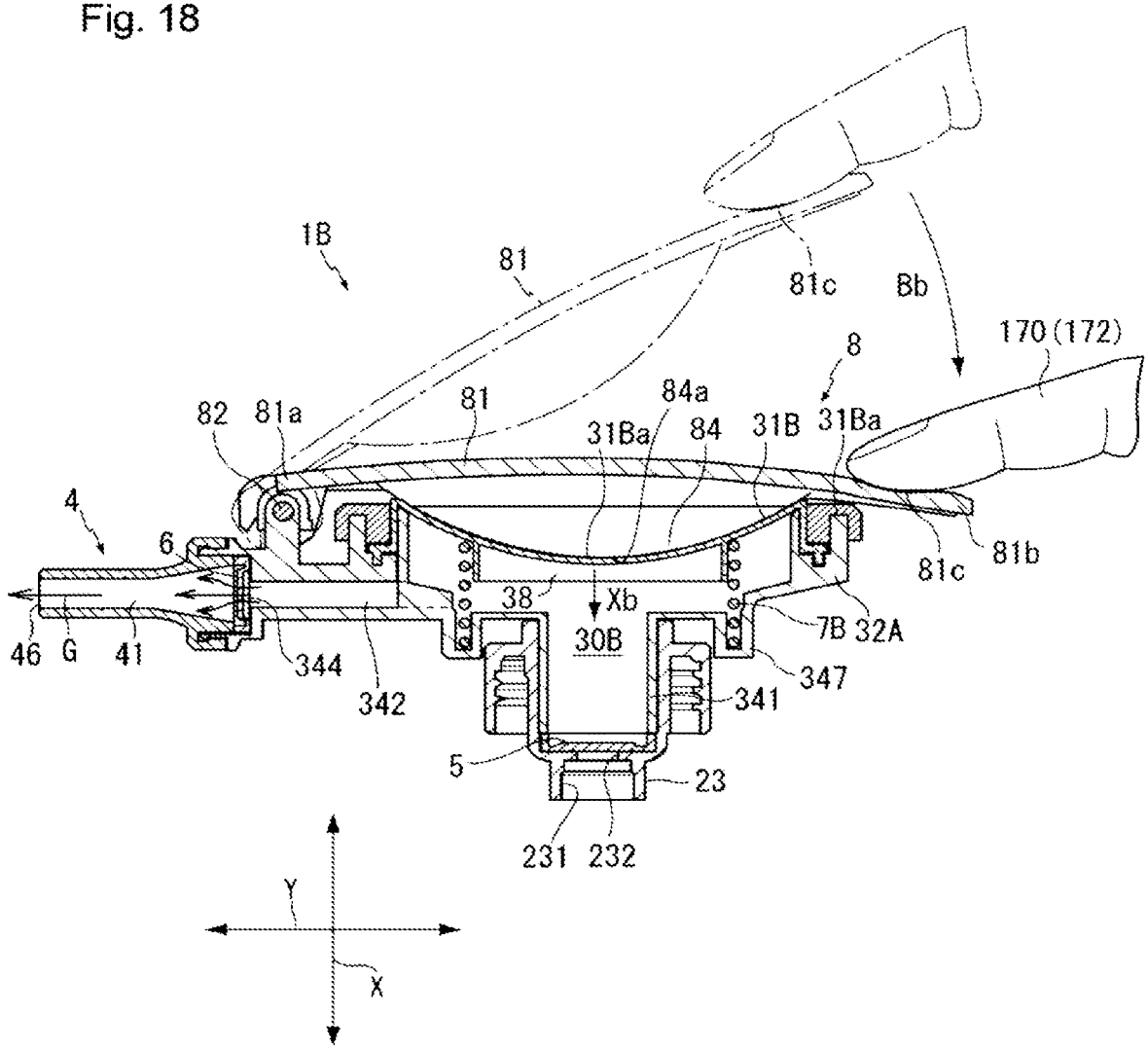
FIG. 18 is a sectional view showing a state after the discharge operation of the dispenser according to the third embodiment.
Figure 19:
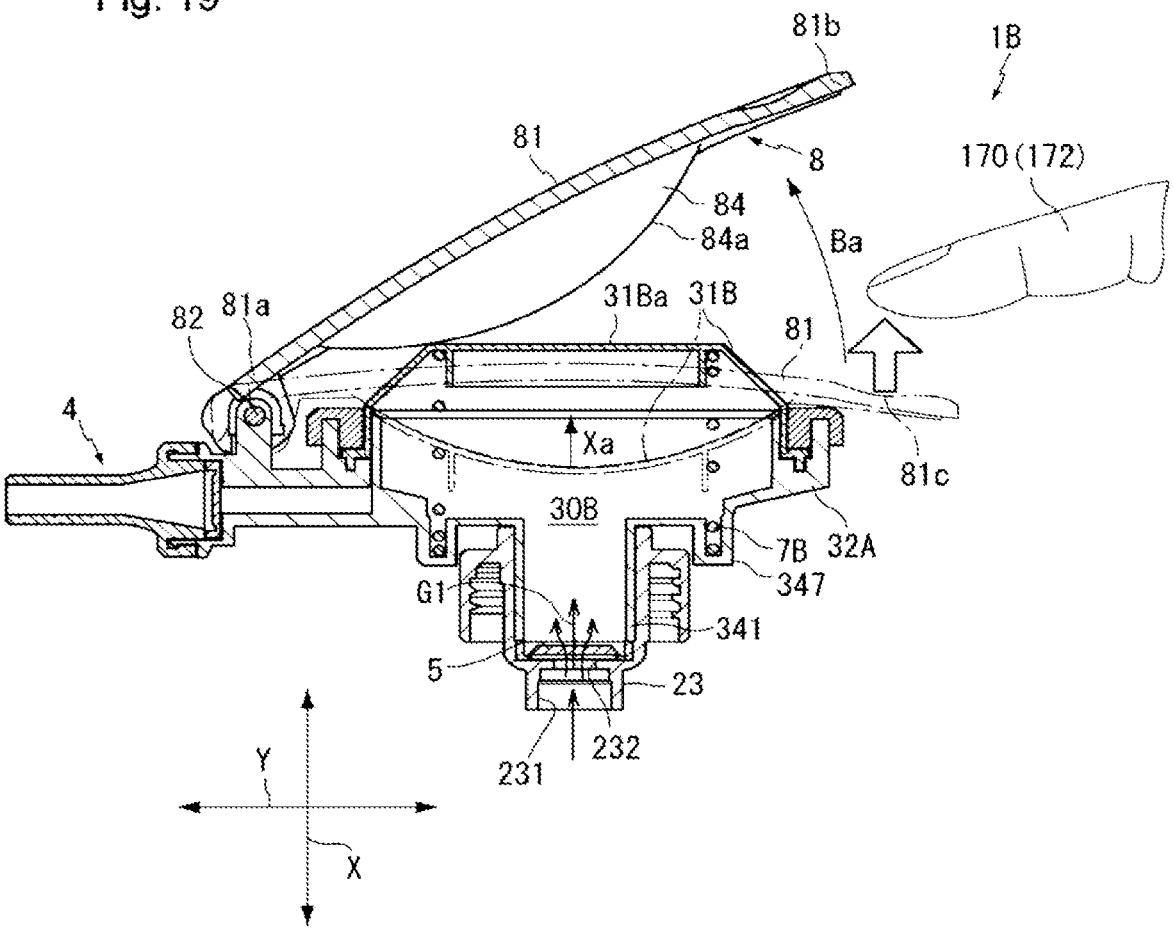
FIG. 19 is a sectional view showing a state restored from the state after the discharge operation of the dispenser according to the third embodiment.

As shown in FIG. 14 and FIG. 16, the pressing portion 8 includes a pressurization lever 81. The pressurization lever 81 is placed above the lid body 31B, and is operated when deforming the lid body 31B in the discharge operation direction Xb. The pressurization lever 81 is swingably supported by the casing 32B with a shaft 82. Explaining in detail, between the outer peripheral surface 32Bg of the casing 32B and the nozzle fitting portion 343, a hinge portion 83 to which the shaft 82 is attached is formed. The shaft 82 extends in a diameter direction Y, and swingably supports one end 81*a* of the pressurization lever 81 as a swing end. The other end 81*b* of the pressurization lever 81 is a free end, and a recessed portion 81*c* is formed on a surface thereof. The recessed portion 81*c* is formed so that a thick part of the human finger 170 is placed thereon when operating the pressurization lever 81, and prevents a positional deviation of the finger 170 during operation. In the drawings, an arrow B shows a swing direction of the pressurization lever 81, an arrow Ba in FIG. 19 shows a pressurization releasing direction to release pressurization to the lid body 31B, and an arrow Bb in FIG. 18 shows a pressurization direction to deform the lid body 31B in the discharge operation direction Xb. As shown in FIG. 17, an entire length W of the pressurization lever 81 is formed to be longer than a diameter RB of the lid body 31B.

A pressurization portion 84 is formed on an inner surface 81*d* of the pressurization lever 81 that faces a flat top surface 31Ba of the lid body 31B. In the pressurization portion 84, a facing surface 84*a* that faces the top surface 31Ba is formed into a circular-arc shape that is projected toward the top surface 31Ba. The pressurization portion 84 is formed with a predetermined width in an axial length direction of the shaft 82. The width is set at a substantially equivalent length to a diameter of the top surface 31Ba. A length W1 in the diameter direction Y of the pressurization portion 84 is formed to be longer than a diameter of the opening 33. A height H that is from the inner surface 81*d* to a central portion 84*b* of the facing surface 84*a*, and is a protrusion amount of the pressurization portion 84 is set so that a necessary deformation amount L3 is obtained when the lid body 31B is pushed into the pump chamber 30B, as shown in FIG. 17. Deformation of the lid body 31B in the discharge operation direction Xb is restricted by moving the pressurization lever 81 in the pressurization direction Bb and the other end 81*b* abutting on a top surface 37Ba of a stop member 37B.

As shown in FIG. 17, in the present embodiment, a diameter RB1 of the coil spring 7B is formed to be larger than a radius RB2 of the lid body 31B. The deformation amount L3 of the lid body 31B is equal to or more than ⅓ of the diameter RB of the lid body 31B. The deformation amount L3 is a distance from the top surface 31Ba of the lid body 31B before deformation to the top surface 31Ba at a time of the lid body 31B being most deformed in the discharge operation direction Xb, and is a pump stroke amount. Further, the diameter RB of the lid body 31B is a direct distance between outer surfaces 31Bd of parts that face each other of the lid body 31B in a state where the lid body 31B is fitted in the fitting groove 345 with the stop member 37B. A protrusion amount t1 of an annular rib 38*a* is formed to be longer than a diameter RB3 of a wire rod of the coil spring 7B. A diameter R4 of the annular rib 38*a* is formed to be slightly smaller than an inside diameter R5 of the coil spring 7B, so that the coil spring 7B is easily fittable to the annular rib 38*a* at the time of fitting the coil spring 7B.

The coil spring 7B according to the present embodiment is formed of a wire rod with a smaller diameter RB3 than a diameter of a wire rod that forms an ordinary coil spring with a same diameter. In other words, a ratio of the diameter RB1 of the coil spring to the diameter RB3 of the wire rod forming the coil spring 7B (RB1/RB3) is 10 or more and 20 or less. Further, a spring constant of the coil spring 7B is set to be larger than a spring constant of the coil spring 7, and a repulsive force is made stronger than that of the coil spring 7. When the pressurization operation to the lid body 31B by the pressurization lever 81 is released, the lid body 31B moves in the restoration direction Xa by an own restoring force and the repulsive force of the coil spring 7B, and at this time, the pressurization lever 81 is in a state riding on the lid body 31B. Thereby, a weight of the pressurization lever 81 acts when the lid body 31B moves in the restoration direction Xa, and therefore, the spring constant of the coil spring 7B is made larger than the coil spring 7.

In the dispenser 1B according to the present embodiment, after the dispenser 1B is fitted to the liquid accommodation container 100B, the pressurization lever 81 is pushed down to the pressurization direction Bb from an initial position shown by an alternate long and short dashes line with the thick part of the finger 170, for example, placed on the recessed portion 81*c*, as shown in FIG. 18. When the lid body 31B is pushed to the discharge operation direction Xb against the repulsive force of the coil spring 7B as movement in the pressurization direction Bb of the pressurization lever 81 advances, the pressing force is applied to the entire lid body from the top surface 31Ba, and the lid body greatly bends into the pump chamber 30B. Thereby, a capacity in the pump chamber 30B decreases to increase pressure in the chamber to stop a flow of the liquid from the suction port 232 with the suction valve 5, whereas the discharge valve 6 opens to open the discharge port 344, and a fixed amount of the liquid G in the pump chamber 30B is discharged from a discharge port 46 via the nozzle inner flow path 41.

When the user releases the finger 170 from the pressurization lever 81 to loosen the pressing force applied to the pressurization lever 81 to release the pressurization operation, for example, the lid body 31B moves to the restoration direction Xa by the repulsive force of the coil spring 7B, as shown in FIG. 19. Further, the lid body 31B changes to be restored to the original shape before deformation and pushes the pressurization lever 81 back to the initial position shown by a solid line. Since the inner pressure of the pump chamber 30B decreases due to movement in the restoration direction Xa of the lid body 31B the discharge valve 6 is closed to close the discharge port 344, whereas the suction valve 5 opens to open the suction port 232, and a fixed amount of the liquid G1 in the liquid accommodation container 100B is sucked into the pump chamber 30B via the suction port 232 and the suction path 341.

As above, in the dispenser 1B according to the present embodiment, the diameter RB1 of the coil spring 7B that is arranged in the pump chamber 30B and urges the lid body 31B in the restoration direction Xa is formed to be larger than the radius RB2 of the lid body 31B, so that the range where the repulsive force of the coil spring 7B to the inner surface 31Be of the lid body 31B acts also increases. As a result, the entire lid body can be moved to the initial position before the discharge operation and restored as compared with the case of partially restoring the lid body 31B with the coil spring 7B as in the conventional art. Accordingly, the discharge operation is easy, and suction of the liquid into the pump chamber 30B is also favorable, regardless of the amount of discharge in design of the dispenser 1B.

Further, since the diameter RB3 of the wire rod of the coil spring 7B is formed to be smaller than the diameter of the wire rod that forms an ordinary coil spring with the same diameter, the lid body 31B is deformed to the discharge operation direction Xb with a small force at the time of the discharge operation, and restoration of the lid body 31B that is bent can be performed with a sufficient repulsive force at the time of release of the discharge operation. Further, the pressurization lever 81 can be pushed back to the initial position by movement in the restoration direction Xa of the lid body 31B. Further, by performing a swing operation of the pressurization lever 81, the lid body 31B is deformed in the discharge operation direction Xb and the liquid G can be discharged from the discharge port 46 at a nozzle tip end 4*a* of the nozzle portion 4, so that operability to the lid body 31B that is provided in the casing 32B with a large diameter is particularly good.

The diameter RB of the lid body 31B used in the dispenser 1B with a large capacity is preferably equal to or more than 50 mm, more preferably equal to or more than 55 mm, preferably equal to or less than 100 mm, more preferably equal to or less than 95 mm, preferably 50 mm or more and 100 mm or less, and more preferably 55 mm or more and 95 mm or less. Note that the diameter RB of the lid body 31B is desirably determined in consideration of the diameter of the casing 32B.

Although the preferable embodiments of the present invention are described thus far, the present invention is not limited to these specific embodiments, and various modifications and changes can be made within the scope of the gist of the present invention described in the claims unless specially limited in the aforementioned explanation.

For example, in the aforementioned embodiment, the lid body 31 has the substantially flat top surface 31*a*, but may locally have projections on the top surface 31*a*. Having such projections is preferable because a function as slip resistance at the time of the user pressing and pushing the lid body 31 is included.

In the aforementioned embodiment, the coil springs 7 and 7B are described as the compression coil springs with equal pitches, but coil springs with unequal pitches may be used. In this case, the lid bodies 31 and 31B can also be deformed into the pump chambers 30, 30A and 30B sufficiently with a small pressing force at the time of the discharge operation, and a spring that can provide a repulsive force that can reliably restore the lid bodies 31 and 31B to the state before the discharge operation at the time of release of the discharge operation is preferably selected.

The dispenser 1 of the first embodiment can also be used by being fitted to the upper portion of the self-supporting liquid accommodation container 100A. In the third embodiment, the restoring force of the lid body 31B itself and the repulsive force of the coil spring 7B are used to return the pressurization lever 81 to the initial position, but a torsion coil spring may be arranged at the shaft 82 as an urging member, and the pressurization lever 81 may be given a rotation correction to the initial position to return. In this case, a load to the coil spring 7B and the lid body 31B is reduced, so that it is preferable because occurrence of poor return of the lid body 31B can be prevented even if the spring constant is decreased.

Concerning the aforementioned embodiments, the present invention further discloses the following dispensers.

<1>

A dispenser in which a pump chamber is formed by a body including a depression, and a lid body covering an opening of the depression, a liquid in the pump chamber is discharged from a nozzle portion by performing a discharge operation that presses the lid body to an inside of the pump chamber to deform the lid body, and a liquid is caused to flow into the pump chamber by releasing the discharge operation, including a coil spring that is arranged in the pump chamber, and urges the lid body to an outside of the pump chamber, wherein a diameter of the coil spring is larger than a radius of the lid body, and a deformation amount of the lid body is equal to or more than ⅓ of a diameter of the lid body.

<2>

The dispenser as set forth in clause <1>, wherein a ratio of a diameter R1 of the coil spring to a diameter R3 of a wire rod forming the coil spring (R1/R3) is 10 or more and 30 or less.

<3>

The dispenser as set forth in clause <1> or <2>, wherein the diameter of the lid body is equal to or less than 45 mm.

<4>

The dispenser as set forth in any one of clauses <1> to <3>, wherein the lid body is provided to bulge on an opposite side to the body, and includes a substantially flat top surface.

<5>

The dispenser as set forth in clause <4>, wherein the lid body includes a bulging curved surface that bulges toward the top surface from an opening side located at an opposite side to the top surface, and a boundary between the top surface and the bulging curved surface includes an edge portion in a substantially circular shape.

<6>

The dispenser as set forth in clause <5>, wherein the coil spring abuts on an inner surface inside from the edge portion of the lid body.

<7>

The dispenser as set forth in any one of clauses <1> to <6>, wherein the coil spring is engaged with a spring receiving portion formed on an inner surface of the lid body.

<8>

The dispenser as set forth in clause <7>, wherein the spring receiving portion includes an annular rib that is protruded to an inside of the pump chamber from the inner surface of the lid body.

<9>

The dispenser as set forth in clause <8>, wherein a protrusion amount of the annular rib is formed to be longer than a diameter of a wire rod forming the coil spring.

<10>

The dispenser as set forth in clause <4>, wherein the top surface locally includes projections.

<11>

The dispenser as set forth in any one of clauses <1> to <10>, wherein an inner end portion of the body is formed to be one step lower in a discharge operation direction than an end surface of the body.

<12>

The dispenser as set forth in any one of clauses <1> to <11>, wherein the body includes an inner cylindrical portion that is located on an inner surface side of the lid body, and the inner cylindrical portion is continuously formed throughout an entire periphery of the opening.

<13>

The dispenser as set forth in any one of clauses <1> to <12>, wherein the body includes an inner cylindrical portion that is located on an inner surface side of the lid body, and a distance from an upper end of the inner cylindrical portion to an inner side surface of a top surface portion of the lid body is longer than a distance from the inner cylindrical portion to the coil spring.

<14>

A dispenser in which a pump chamber is formed by a body including a depression, and a lid body covering an opening of the depression, a liquid in the pump chamber is discharged from a nozzle portion by performing a discharge operation that presses the lid body to an inside of the pump chamber to deform the lid body, and a liquid is caused to flow into the pump chamber by releasing the discharge operation, including a coil spring that is arranged in the pump chamber, and urges the lid body to an outside of the pump chamber, wherein the body includes an inner cylindrical portion that abuts on an inner surface side of the lid body, and the inner cylindrical portion is continuously formed throughout an entire periphery of the opening.

<15>

The dispenser as set forth in clause <14>, wherein a diameter of the coil spring is larger than a radius of the lid body.

<16>

The dispenser as set forth in clause <14> or <15>, wherein a deformation amount of the lid body is equal to or more than ⅓ of a diameter of the lid body.

<17>

The dispenser as set forth in any one of clauses <14> to <16>, wherein a ratio of a diameter R1 of the coil spring to a diameter R3 of a wire rod forming the coil spring (R1/R3) is 10 or more and 30 or less.

<18>

The dispenser as set forth in any one of clauses <14> to <17>, wherein a diameter of the lid body is equal to or less than 45 mm.

<19>

The dispenser as set forth in any one of clauses <14> to <18>, wherein the lid body is provided to bulge on an opposite side to the body, and includes a substantially flat top surface.

<20>

The dispenser as set forth in clause <19>, wherein the lid body includes a bulging curved surface that bulges toward the top surface from an opening side located on an opposite side to the top surface, and a boundary of the top surface and the bulging curved surface includes a substantially circular edge portion.

<21>

The dispenser as set forth in clause <20>, wherein the coil spring abuts on an inner surface inside from an edge portion of the lid body.

<22>

The dispenser as set forth in any one of clauses <14> to <21>, wherein the coil spring is engaged with a spring receiving portion formed on an inner surface of the lid body.

<23>

The dispenser as set forth in clause <22>, wherein the spring receiving portion includes an annular rib protruded toward the inside of the pump chamber from the inner surface of the lid body.

<24>

The dispenser as set forth in clause <23>, wherein a protrusion amount of the annular rib is formed to be longer than a diameter of a wire rod forming the coil spring.

<25>

The dispenser as set forth in clause <19>, wherein the top surface locally includes projections

<26>

The dispenser as set forth in any one of clauses <14> to <25>, wherein an inner end portion of the body is formed to be one step lower in a discharge operation direction than an end surface of the body.

<27>

The dispenser as set forth in any one of clauses <14> to <26>, wherein a distance from an upper end of the inner cylindrical portion to an inner side surface of a top surface portion of the lid body is longer than a distance from the inner cylindrical portion to the coil spring.

INDUSTRIAL APPLICABILITY

According to the dispenser of the present invention, the discharge operation is easy, and suction of the liquid into the pump chamber is also favorable, regardless of the amount of discharge in design.

The invention claimed is:

1. A dispenser, comprising:

a pump chamber formed by a body including a depression and a lid body covering an opening of the body, wherein a first liquid in the pump chamber is discharged from a nozzle portion by performance of a discharge operation that presses the lid body into an inside of the pump chamber to deform the lid body, and a second liquid is caused to flow into the pump chamber by release of the discharge operation; and a coil spring that is arranged in the pump chamber and urges the lid body to an outside of the pump chamber, wherein a diameter of the coil spring is larger than a radius of the lid body, and a deformation amount of the lid body is equal to or more than ⅓ of a diameter of the lid body.

2. The dispenser according to claim 1, wherein a ratio of a diameter R1 of the coil spring to a diameter R3 of a wire rod forming the coil spring (R1/R3) is 10 or more and 30 or less.

3. The dispenser according to claim 1, wherein the diameter of the lid body is equal to or less than 45 mm.

4. The dispenser according to claim 1, wherein the lid body is provided to bulge on an opposite side to the body, and includes a substantially flat top surface.

5. The dispenser according to claim 4, wherein the lid body includes a bulging curved surface that bulges toward the top surface from an opening side located at an opposite side to the top surface, and a boundary between the top surface and the bulging curved surface includes an edge portion in a substantially circular shape.

6. The dispenser according to claim 5, wherein the coil spring abuts on an inner surface inside from the edge portion of the lid body.

7. The dispenser according to claim 1, wherein the coil spring is engaged with a spring receiving portion formed on an inner surface of the lid body.

8. The dispenser according to claim 7, wherein the spring receiving portion includes an annular rib that is protruded to an inside of the pump chamber from the inner surface of the lid body.

9. The dispenser according to claim 8, wherein a protrusion amount of the annular rib is formed to be longer than a diameter of a wire rod forming the coil spring.

10. The dispenser according to claim 4, wherein the top surface includes projections.

11. The dispenser according to claim 1, wherein an inner end portion of the body is formed to be lower in a discharge operation direction than an end surface of the body.

12. The dispenser according to claim 1, wherein the body includes an inner cylindrical portion that abuts on an inner surface side of the lid body, and the inner cylindrical portion is continuously formed throughout an entire periphery of the opening.

13. The dispenser according to claim 1, wherein the body includes an inner cylindrical portion that abuts on an inner surface side of the lid body, and a distance from an upper end of the inner cylindrical portion to an inner side surface of a top surface portion of the lid body is longer than a distance from an upper end portion of the inner cylindrical portion to the coil spring.

14. A dispenser, comprising:

a pump chamber formed by a body including a depression and a lid body covering an opening of the body, wherein a first liquid in the pump chamber is discharged from a nozzle portion by performance of a discharge operation that presses the lid body into an inside of the pump chamber to deform the lid body, and a second liquid is caused to flow into the pump chamber by release of the discharge operation; and a coil spring that is arranged in the pump chamber and urges the lid body to an outside of the pump chamber, wherein a diameter of the coil spring is larger than a radius of the lid body, the body includes an inner cylindrical portion that abuts on an inner surface side of the lid body, and the inner cylindrical portion is continuously formed throughout an entire periphery of the opening.

15. The dispenser according to claim 14, wherein a ratio of a diameter R1 of the coil spring to a diameter R3 of a wire rod forming the coil spring (R1/R3) is 10 or more and 30 or less.

16. The dispenser according to claim 14, wherein a diameter of the lid body is equal to or less than 45 mm.

17. The dispenser according to claim 14, wherein the lid body is provided to bulge on an opposite side to the body, and includes a substantially flat top surface.

18. The dispenser according to claim 17, wherein the lid body includes a bulging curved surface that bulges toward the top surface from an opening side located on an opposite side to the top surface, and a boundary of the top surface and the bulging curved surface includes a substantially circular edge portion.

19. The dispenser according to claim 18, wherein the coil spring abuts on an inner surface inside from an edge portion of the lid body.

20. The dispenser according to claim 14, wherein the coil spring is engaged with a spring receiving portion formed on an inner surface of the lid body.

* * * * *